US010415575B2

(12) United States Patent
Horng et al.

(10) Patent No.: US 10,415,575 B2
(45) Date of Patent: Sep. 17, 2019

(54) CEILING FAN, HANGER ASSEMBLY OF THE CEILING FAN, AND MOUNTING BRACKET OF THE HANGER ASSEMBLY

(71) Applicant: Sunonwealth Electric Machine Industry Co., Ltd., Kaohsiung (TW)

(72) Inventors: Alex Horng, Kaohsiung (TW); Tso-Kuo Yin, Kaohsiung (TW); Duo-Nian Shan, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 353 days.

(21) Appl. No.: 15/381,168

(22) Filed: Dec. 16, 2016

(65) Prior Publication Data

US 2017/0204869 A1 Jul. 20, 2017

(30) Foreign Application Priority Data

Jan. 19, 2016 (TW) ..... 105101573 A

(51) Int. Cl.

| | |
|---|---|
| ***F04D 29/64*** | (2006.01) |
| ***F04D 25/08*** | (2006.01) |
| ***F04D 25/06*** | (2006.01) |
| ***F04D 29/60*** | (2006.01) |

(52) U.S. Cl.

CPC ..... *F04D 25/088* (2013.01); *F04D 25/06* (2013.01); *F04D 25/0693* (2013.01); *F04D 29/601* (2013.01)

(58) Field of Classification Search

CPC .... F04D 25/088; F04D 29/60; F04D 25/0693; F16M 11/041; F16M 2220/02

See application file for complete search history.

(56) References Cited

U.S. PATENT DOCUMENTS

| | | | | |
|---|---|---|---|---|
| 4,538,973 | A * | 9/1985 | Angott | G08C 17/02 174/54 |
| 5,090,654 | A * | 2/1992 | Ridings | F04D 29/601 248/288.31 |
| 5,135,365 | A * | 8/1992 | Bogage | F04D 25/088 416/244 R |
| 6,872,054 | B2 * | 3/2005 | Pearce | F04D 29/601 248/342 |
| 7,874,798 | B2 | 1/2011 | Frampton et al. | |
| 8,152,453 | B2 | 4/2012 | Oleson | |
| 9,587,518 | B2 | 3/2017 | Oleson | |
| 2010/0314520 | A1 | 12/2010 | Collmar | |
| 2015/0333592 | A1 | 11/2015 | Yin et al. | |

FOREIGN PATENT DOCUMENTS

| | | |
|---|---|---|
| TW | 477407 U | 2/2002 |
| TW | M334207 U | 6/2008 |

* cited by examiner

*Primary Examiner* — Ninh H. Nguyen

(74) *Attorney, Agent, or Firm* — Alan D. Kamrath; Mayer & Williams PC

(57) ABSTRACT

A ceiling fan, a hanger assembly of the ceiling fan, and a mounting bracket of the hanger assembly are designed with a lower failure rate. The hanger assembly of the ceiling fan includes a coupling rod and a fan rod. The mounting bracket has two lateral walls opposing to each other. Each of the two lateral walls includes a mounting end, a hanger end and a receiving portion. The coupling rod has two ends respectively received in the receiving portions of the two lateral walls. The fan rod has a first end coupled with the coupling rod, as well as a second end coupled with a stator of a motor of the ceiling fan.

42 Claims, 14 Drawing Sheets

CEILING FAN, HANGER ASSEMBLY OF THE CEILING FAN, AND MOUNTING BRACKET OF THE HANGER ASSEMBLY

CROSS REFERENCE TO RELATED APPLICATIONS

The application claims the benefit of Taiwan application serial No. 105101573, filed on Jan. 19, 2016, and the subject matter of which is incorporated herein by reference.

BACKGROUND OF THE INVENTION

1. Field of the Invention

The present invention generally relates to a ceiling fan, a hanger assembly of the ceiling fan, and a mounting bracket of the hanger assembly and, more particularly, to a hanger assembly having a mounting bracket to which a coupling rod is pivotally coupled, as well as a ceiling fan having the hanger assembly.

2. Description of the Related Art

FIG. 1 shows a hanger assembly 9 of a conventional ceiling fan. The hanger assembly 9 includes a mounting bracket 91, a bracket-coupling portion 92 and a fan rod 93. The bracket-coupling portion 92 is coupled with the mounting bracket 91, and the fan rod 93 can be coupled with the bracket-coupling portion 92. The mounting bracket 91 can be fixed to the ceiling, and the fan rod 93 can be coupled with a ceiling fan. As such, the ceiling fan can be hung on the hanger assembly 9 below the ceiling.

However, the ceiling fan is usually heavy. As such, when the fan rod 93 and the ceiling fan experience an external force (resulting from an earthquake, for example), the bracket-coupling portion 92 or the fan rod 93 may break under a stress concentrating on the interconnected part between the bracket-coupling portion 92 and the mounting bracket 91 or between the bracket-coupling portion 92 and the fan rod 93. In order to prevent breaking of the bracket-coupling portion 92 or the fan rod 93, the bracket-coupling portion 92 is often provided with a rounded face 921 (which is commonly known as a "mushroom head" due to its shape) through which the bracket-coupling portion 92 is coupled with the mounting bracket 91. In this arrangement, the bracket-coupling portion 92 is able to displace relative to the mounting bracket 91 when the fan rod 93 and the ceiling fan experience the external force. As such, the fan rod 93 and the ceiling fan can swing as the bracket-coupling portion 92 swings, preventing breaking of the bracket-coupling portion 92 or the fan rod 93.

During the operation where the ceiling fan drives the blades to rotate, the ceiling fan always experiences a torque F acting in a circumferential direction perpendicular to an axial direction X. However, since the bracket-coupling portion 92 is coupled with the mounting bracket 91 via the rounded face 921, the bracket-coupling portion 92 will pivot about an axle parallel to the axial direction X under the torque F. As a result, the ceiling fan always shakes every time it starts, leading to an impact on the service life of the hanger assembly 9 or the ceiling fan.

Moreover, a lead wire W often extends inside the bracket-coupling portion 92 and the fan rod 93. Therefore, when the bracket-coupling portion 92 pivots about the axle parallel to the axial direction X, the lead wire W in the bracket-coupling portion 92 and the fan rod 93 will be twisted. As a result, the lead wire W can be twisted apart under the twisting force, leading to a high failure rate of the ceiling fan.

In light of this, it is necessary to provide a novel ceiling fan, a novel hanger assembly of the ceiling fan, and a novel mounting bracket of the hanger assembly, to prolong the service life of the ceiling fan and the hanger assembly and to reduce the failure rate of the ceiling fan.

SUMMARY OF THE INVENTION

It is therefore the objective of this disclosure invention to provide a novel ceiling fan, a novel hanger assembly of the ceiling fan, and a novel mounting bracket of the hanger assembly. Through the arrangement of two receiving portions respectively on two lateral walls of the mounting bracket, two ends of a coupling rod may be respectively received in the two lateral walls while a fan rod is coupled with the coupling rod for connection with the mounting bracket.

In an embodiment of the invention, a hanger assembly of a ceiling fan is disclosed. The hanger assembly includes a mounting bracket, a coupling rod and a fan rod. The mounting bracket has two lateral walls opposite to each other. Each of the two lateral walls includes a mounting end, a hanger end and a receiving portion. The coupling rod has two ends respectively received in the receiving portions of the two lateral walls. The fan rod has a first end coupled with the coupling rod, as well as a second end coupled with a stator of the motor of the ceiling fan.

In a preferred form shown, the mounting end and the hanger end of the mounting bracket are spaced from each other in an axial direction. The two lateral walls are opposite to each other in a first direction perpendicular to the axial direction. The receiving portion is spaced from the hanger end in the axial direction, and the receiving portions of the two lateral walls are aligned with each other in the first direction. As such, the coupling rod is able to pivot about an axle parallel to the first direction in the receiving portions of the two lateral walls.

In the preferred form shown, the receiving portion is in a form of an opening extending through the lateral wall in the first direction. As such, two ends of the coupling rod respectively extend into the receiving portions of the two lateral walls, increasing the contact areas between the coupling rod and the two lateral walls.

In the preferred form shown, the receiving portion is in a form of a blind hole. As such, the two ends of the coupling rod are not exposed out of the two lateral walls and will not become rusty easily.

In the preferred form shown, the first and second ends of the fan rod are spaced from each other in the axial direction. Based on this, the coupling rod can be coupled with the first end of the fan rod, and the stator of the motor can be coupled with the second end of the fan rod. As such, the stator of the motor can be hung on the mounting bracket.

In the preferred form shown, the receiving portion includes a shrinking section having a larger end relatively adjacent to the mounting end, as well as a smaller end relatively adjacent to the hanger end. The shrinking section has a maximal diameter in a second direction, as well as a minimal diameter in the second direction. The maximal diameter is located at the larger end, and the minimal diameter is located at the smaller end. The coupling rod has two ends. The shrinking section has a diameter that gradually reduces from the position of the maximal diameter to the position of the minimal diameter. The maximal diameter of the shrinking section is larger than an outer diameter of each of the two ends of the coupling rod, and the minimal diameter of the shrinking section is smaller than or equal to the outer diameter of each of the two ends of the coupling rod. In this regard, the two ends of the coupling rod can be respectively placed into the receiving portions of the two lateral walls via the larger end of the shrinking section relatively adjacent to the mounting end. Since the maximal diameter is larger than the outer diameter, the two ends of the coupling rod can be easily placed into the receiving portions of the two lateral walls, respectively. Thus, the engagement between the coupling rod and the mounting bracket is convenient.

In the preferred form shown, the shrinking section includes two lateral edges spaced from each other in the second direction, and each of the two lateral edges is in a linear form on a plane perpendicular to the first direction. Therefore, each of the two ends of the coupling rod may displace towards the hanger end down the shrinking section and become engaged with the receiving portion, thus fixing the two ends of the coupling rod in place.

In the preferred form shown, the minimal diameter of the shrinking section is equal to the outer diameter of each of the two ends of the coupling rod. The shrinking section includes two lateral edges spaced from each other in the second direction. The receiving portion further includes a connection section connected between the two lateral edges of the shrinking section at the smaller end of the shrinking section. The connection section is in an arched form. As such, the two ends of the coupling rod can be engaged at the bottom side of the receiving portions while the two lateral edges of the shrinking section are able to provide the coupling rod with a reinforced supporting force.

In the preferred form shown, the minimal diameter of the shrinking section is smaller than the outer diameter of each of the two ends of the coupling rod. The shrinking section includes two lateral edges spaced from each other in the second direction. The receiving portion further includes a connection section connected between the two lateral edges of the shrinking section at the smaller end of the shrinking section. A spacing is formed between an outer periphery of each of the two ends of the coupling rod and an inner periphery of the connection section of the receiving portion of a respective one of the two lateral walls. As such, the end of the coupling rod will displace further down the shrinking section towards the hanger end under gravity when the two ends of the coupling rod have worn down. As a result, the two ends of the coupling rod can remain engaged with the receiving portions, ensuring a stable coupling effect between the coupling rod and the mounting bracket.

In the preferred form shown, the first end of the fan rod is coupled with the coupling rod via a connection member. The connection member includes a retaining portion and a coupling portion. The retaining portion is fixed to the first end of the fan rod, and the coupling portion is pivotally coupled with the coupling rod. Alternatively, the retaining portion is fixed to the coupling rod, and the coupling portion is pivotally coupled with the first end of the fan rod. Based on this, the coupling portion is able to pivot about an axle parallel to a second direction perpendicular to the axial direction and the first direction. As such, when the stator of the motor and the fan rod experience an external force, they will swing along a plane perpendicular to the second direction. Thus, stress will not concentrate on the interconnected part between the fan rod and the coupling rod, effectively preventing breaking of the coupling rod or the fan rod.

In the preferred form shown, the coupling portion is in a form of a though-hole and coupled with a shaft, and the shaft is parallel to the second direction. As such, the coupling portion is able to pivot about an axle parallel to the second direction.

In the preferred form shown, the coupling rod includes a hole through which the shaft extends, in which the retaining portion is fixed to the first end of the fan rod, and the coupling portion is pivotally coupled with the coupling rod. Based on this, the coupling rod cannot pivot about an axle parallel to the axial direction. Therefore, when the stator of the motor experiences the torque, the arrangement of the coupling portion will not cause the stator of the motor and the fan rod to pivot about the axle parallel to the axial direction.

In the preferred form shown, the coupling portion includes a reducing portion which has a larger end relatively adjacent to the first end of the fan rod, as well as a smaller end relatively distant to the first end of the fan rod. The reducing portion has an inner diameter that gradually reduces from the larger end to the smaller end. The reducing portion has a maximal inner diameter in the first direction, as well as a minimal inner diameter in the first direction. The maximal inner diameter is located at the larger end, and the minimal inner diameter is located at the smaller end. The shaft has an outer diameter at each of two ends thereof. The reducing portion has an inner diameter that gradually reduces from the position of the maximal inner diameter to the position of the minimal inner diameter. The maximal inner diameter is larger than the outer diameter, and the minimal inner diameter is smaller than or equal to the outer diameter. Based on this, when it is desired to extend the shaft through the coupling portion in order to couple the shaft with the coupling portion, the shaft may extend through the reducing portion via the larger end of the reducing portion relatively adjacent to the first end of the fan rod. In this regard, since the maximal inner diameter is larger than the outer diameter, the shaft can easily extend through the coupling portion, providing a convenient engagement between the coupling portion and the shaft.

In the preferred form shown, the reducing portion has two sides spaced from each other in the first direction, and each of the two sides of the reducing portion is in a linear form on a plane perpendicular to the second direction. As such, when the ceiling fan is hung on the mounting bracket, the coupling portion can be pulled away from the mounting end of the mounting bracket by the fan rod. Based on this, the shaft can displace in a direction away from the first end of the fan rod along the reducing portion until the shaft becomes engaged with the reducing portion. As such, the connection member is fixed in place.

In the preferred form shown, at least one of the two lateral walls includes a step portion arranged between the mounting end and the hanger end. The receiving portion extends through the step portion. A spacing between the mounting ends of the two lateral walls is larger than the length of the coupling rod, and a spacing between the hanger ends of the two lateral walls is smaller than the length of the coupling rod. Based on this, when it is desired to hang the ceiling fan on the mounting bracket, the coupling rod that is located right between the two mounting ends may be placed further into the space between the two lateral walls, and then the coupling rod is placed into the receiving portions of the two lateral walls along the axial direction.

In the preferred form shown, the mounting bracket further includes a bridge portion connected between the hanger ends of the two lateral walls. As such, the structural strength of the mounting bracket is reinforced.

In the preferred form shown, a notch is formed between the hanger ends of the two lateral walls and the bridge portion, and the fan rod extends through the notch. As such, when the coupling rod that is located right between the two mounting ends is placed further into the space between the two lateral walls, the fan rod will not make contact with the mounting bracket.

In the preferred form shown, a wire groove is arranged on an outer periphery of the coupling rod. The wire groove is located between the mounting ends of the two lateral walls and is on the side of the fan rod where the first end is. Based on this, when a lead wire passes through the space right between the two mounting ends and reaches the coupling rod, the lead wire may extend along the wire groove. As such, the lead wire may reach the first end of the fan rod through the wire groove, and extends into the channel of the fan rod.

In the preferred form shown, an electrical box is arranged between the mounting ends of the two lateral walls. The electrical box is provided with a lead wire. The lead wire passes through a space between the mounting ends of the two lateral walls, reaches the coupling rod, and extends to the first end of the fan rod through the wire groove. Based on this, the electrical box is able to receive components such as a driving circuit board, a power converter or a controller, and is electrically connected to the internal components of the stator via the lead wire. As such, the electricity or control signal that is required for the operation of the stator can be provided.

In the preferred form shown, the electrical box includes an engaging portion engaged with one of the two lateral walls. Based on this, the engaging portion is able to provide a sufficient retaining effect for the electrical box, preventing the electrical box from sliding relative to the mounting bracket. Thus, pulling of the lead wire is prevented, thus avoiding damage to the lead wire.

In another embodiment, a ceiling fan is disclosed. The ceiling fan includes the above hanger assembly, a stator of a motor and a rotor of the motor. The rotor of the motor is coupled with a plurality of blades and rotatably coupled with the stator. The stator is coupled with the second end of the fan rod and is able to drive the rotor to rotate.

In a preferred form shown, the stator includes a shaft tube. The second end of the fan rod is connected to the stator via another connection member. The other connection member also includes a retaining portion fixed to the second end of the fan rod, as well as a coupling portion pivotally coupled with the shaft tube. Alternatively, the retaining portion is fixed to the shaft tube, and the coupling portion is pivotally coupled with the second end of the fan. As such, the two ends of the fan rod can be respectively coupled with the stator of the motor and the coupling rod via the two connection members that have the same structure. Thus, it is not necessary to prepare two different molds to manufacture two different connection members for connecting the fan rod to the stator of the motor and the coupling rod, thereby reducing the cost of the hanger assembly of the ceiling fan.

In the preferred form shown, the fan rod includes a channel having two ends respectively in communication with the first and second ends of the fan rod, and the shaft tube of the stator is fixed in the channel of the fan rod. Based on this, the stator of the motor will not pivot relative to the fan rod. As such, when the stator of the motor and the fan rod experience an external force, they will swing together in the first or second direction. As a result, the stator of the motor can be prevented from pivoting relative to the fan rod.

In the preferred form shown, the retaining portions of the two connection members are perpendicular to each other. As such, the coupling effect between the fan rod and the stator of the motor and the coupling rod is reinforced.

In a further embodiment, a mounting bracket of a hanger assembly of a ceiling fan is disclosed. The mounting bracket includes two lateral walls opposite to each other in a first direction. Each of the two lateral walls includes a mounting end and a hanger end that are spaced from each other in an axial direction perpendicular to the first direction. Each of the two lateral walls further includes a receiving portion, and the receiving portions of the two lateral walls receive a coupling rod. As such, the coupling rod is able to pivot about an axle parallel to the first direction in the receiving portions of the two lateral walls.

In a preferred form shown, the receiving portion is spaced from the hanger end in the axial direction. As such, the receiving portion may be arranged between the hanger end and the mounting end.

In the preferred form shown, the receiving portion is in a form of an opening extending through the lateral wall in the first direction. As such, two ends of the coupling rod respectively extend into the receiving portions of the two lateral walls, increasing the contact areas between the coupling rod and the two lateral walls.

In the preferred form shown, the receiving portion is in a form of a blind hole. As such, the two ends of the coupling rod are not exposed out of the two lateral walls and will not become rusty easily.

In the preferred form shown, the receiving portion includes a shrinking section having a larger end relatively adjacent to the mounting end, as well as a smaller end relatively adjacent to the hanger end. The shrinking section has a maximal diameter in a second direction, as well as a minimal diameter in the second direction. The maximal diameter is located at the larger end, and the minimal diameter is located at the smaller end. The coupling rod has two ends. The shrinking section has a diameter that gradually reduces from the position of the maximal diameter to the position of the minimal diameter. The maximal diameter of the shrinking section is larger than an outer diameter of each of the two ends of the coupling rod, and the minimal diameter of the shrinking section is smaller than or equal to the outer diameter of each of the two ends of the coupling rod. In this regard, the two ends of the coupling rod can be respectively placed into the receiving portions of the two lateral walls via the larger end of the shrinking section relatively adjacent to the mounting end. Since the maximal diameter is larger than the outer diameter, the two ends of the coupling rod can be easily placed into the receiving portions of the two lateral walls, respectively. Thus, the engagement between the coupling rod and the mounting bracket is convenient.

In the preferred form shown, the shrinking section includes two lateral edges spaced from each other in the second direction, and each of the two lateral edges is in a linear form on a plane perpendicular to the first direction. Therefore, each of the two ends of the coupling rod may displace down the shrinking section towards the hanger end and become engaged with the receiving portion, thus fixing the two ends of the coupling rod in place.

In the preferred form shown, the minimal diameter of the shrinking section is equal to the outer diameter of each of the two ends of the coupling rod. The shrinking section includes two lateral edges spaced from each other in the second direction. The receiving portion further includes a connection section connected between the two lateral edges of the shrinking section at the smaller end of the shrinking section. The connection section is in an arched form. As such, the two ends of the coupling rod can be engaged at the bottom side of the receiving portions while the two lateral edges of the shrinking section are able to provide the coupling rod with a reinforced supporting force.

In the preferred form shown, the minimal diameter of the shrinking section is smaller than the outer diameter of each of the two ends of the coupling rod. The shrinking section includes two lateral edges spaced from each other in the second direction. The receiving portion further includes a connection section connected between the two lateral edges of the shrinking section at the smaller end of the shrinking section. A spacing is formed between an outer periphery of each of the two ends of the coupling rod and an inner periphery of the connection section of the receiving portion of a respective one of the two lateral walls. As such, the end of the coupling rod will displace further down the shrinking section towards the hanger end under gravity when the two ends of the coupling rod have worn down. As a result, the two ends of the coupling rod can remain engaged with the receiving portions, ensuring a stable coupling effect between the coupling rod and the mounting bracket.

In the preferred form shown, at least one of the two lateral walls includes a step portion arranged between the mounting end and the hanger end. The receiving portion extends through the step portion. A spacing between the mounting ends of the two lateral walls is larger than a length of the coupling rod, and a spacing between the hanger ends of the two lateral walls is smaller than the length of the coupling rod. Based on this, when it is desired to hang the ceiling fan on the mounting bracket, the coupling rod that is located right between the two mounting ends may be placed further into the space between the two lateral walls, and then the coupling rod is placed into the receiving portions of the two lateral walls along the axial direction.

In the preferred form shown, the mounting bracket further includes a bridge portion connected between the hanger ends of the two lateral walls. As such, the structural strength of the mounting bracket is reinforced.

In the preferred form shown, a notch is formed between the hanger ends of the two lateral walls and the bridge portion. As such, when the coupling rod that is located right between the two mounting ends is placed further into the space between the two lateral walls, the fan rod will not make contact with the mounting bracket.

In the preferred form shown, an electrical box is arranged between the mounting ends of the two lateral walls. The electrical box is provided with a lead wire. The lead wire passes through a space between the mounting ends of the two lateral walls and reaches the coupling rod. Based on this, the electrical box is able to receive components such as a driving circuit board, a power converter or a controller, and is electrically connected to the internal components of the stator via the lead wire. As such, the electricity or control signal that is required for the operation of the stator can be provided.

In the preferred form shown, the electrical box includes an engaging portion engaged with one of the two lateral walls. Based on this, the engaging portion is able to provide a sufficient retaining effect for the electrical box, preventing the electrical box from sliding relative to the mounting bracket. Thus, pulling of the lead wire is prevented, thus avoiding damage to the lead wire.

Based on the above structure, through the arrangement of the receiving portions on the two lateral walls of the mounting bracket, the two ends of the coupling rod can be respectively received in the receiving portions of the two lateral walls. In this regard, the coupling rod can only rotate in the receiving portions without pivoting about the axle parallel to the axial direction. Therefore, when the stator of the motor experiences the torque, the stator of the motor and the fan rod will not pivot about the axle parallel to the axial direction. Advantageously, shaking of the stator during the initialization process can be effectively prevented, prolonging the service life of the ceiling fan. Moreover, since the stator of the motor, the coupling rod and the fan rod will not pivot about the axle parallel to the axial direction, the lead wire in the wire groove, the channel and the shaft tube will not get twisted and become damaged. Therefore, the failure rate of the ceiling fan can be reduced.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
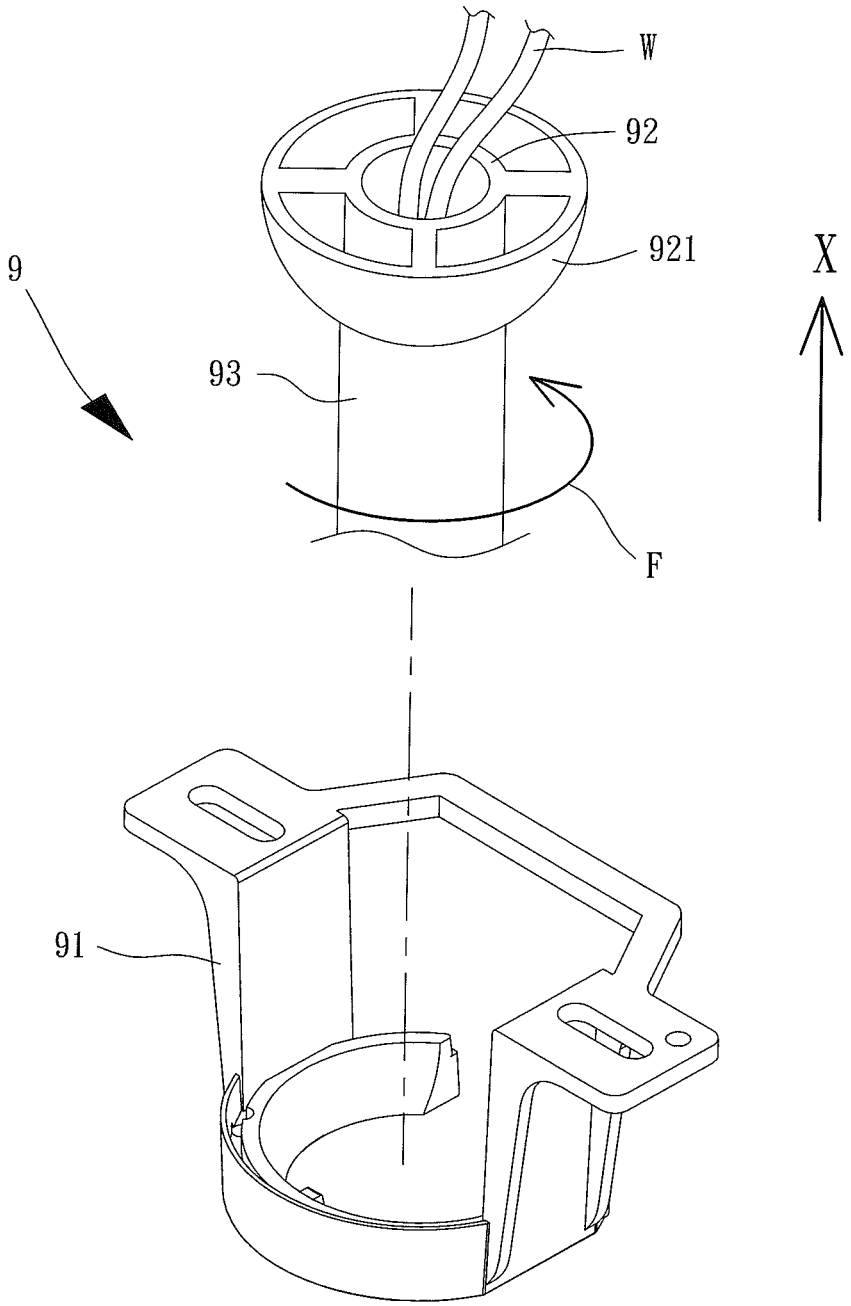
FIG. 1 PRIOR ART
FIG. 1 is an exploded view of a hanger assembly of a conventional ceiling fan.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
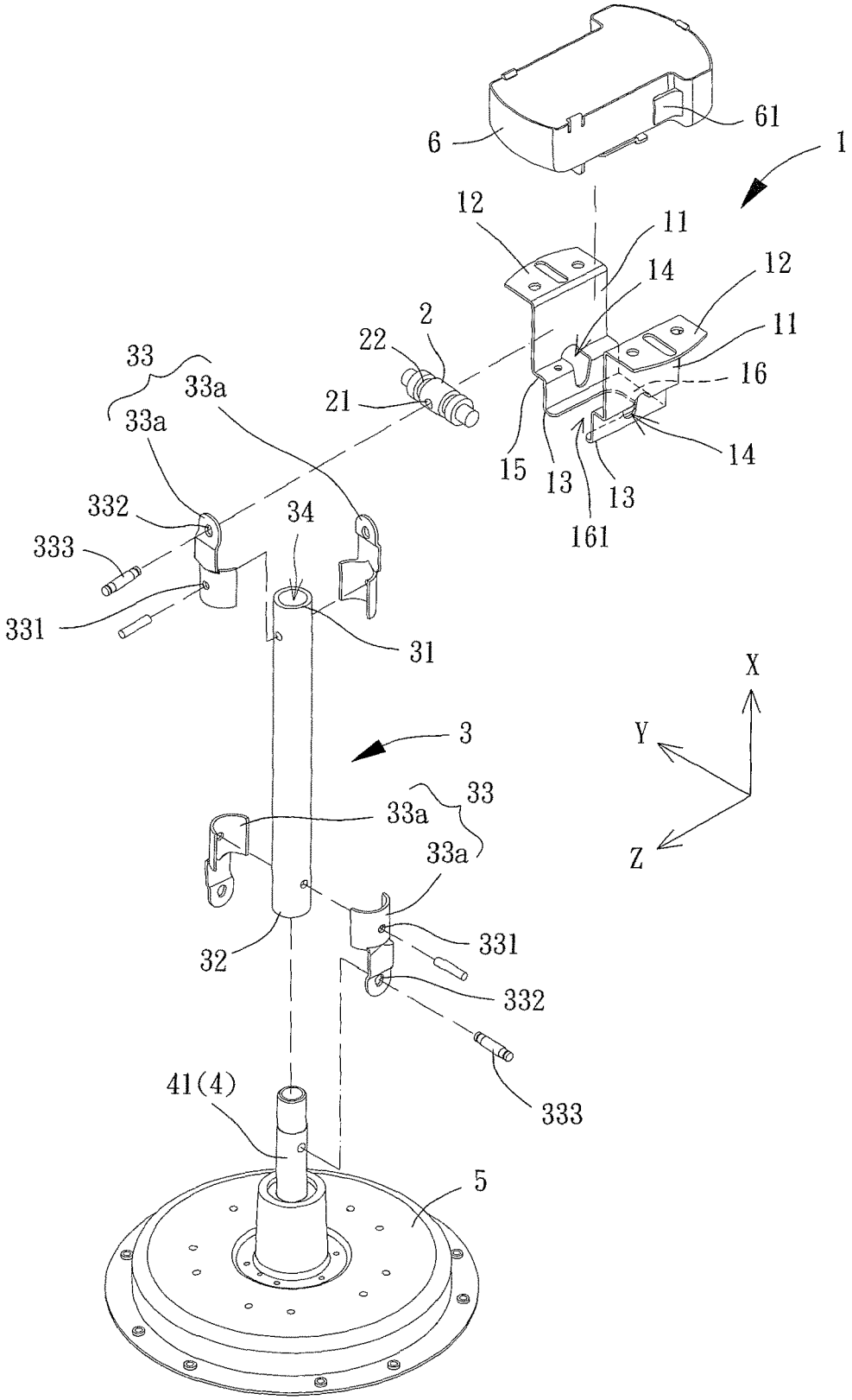
FIG. 2 is an exploded view of a ceiling fan according to an embodiment of the invention.

FIG. 2 is an exploded view of a hanger assembly of a ceiling fan according to an embodiment of the invention. The hanger assembly includes a mounting bracket 1, a coupling rod 2 and a fan rod 3. The coupling rod 2 is coupled with the mounting bracket 1. The fan rod 3 is coupled with the coupling rod 2.

The mounting bracket 1 includes two lateral walls 11. Each of the two lateral walls 11 includes a mounting end 12 and a hanger end 13 spaced from each other in an axial direction X. The two lateral walls 11 are opposite to each other in a first direction Y perpendicular to the axial direction X. The mounting end 12 may be mounted to a predetermined structure such as the ceiling of a building. Each of the two lateral walls 11 further includes a receiving portion 14 spaced from the hanger end 13 in the axial direction X, such that the receiving portion 14 is located between the hanger end 13 and the mounting end 12. In addition, the receiving portions 14 of the two lateral walls 11 are aligned with each other in the first direction Y. In the embodiment, the receiving portion 14 is in the form of an opening extending through the lateral wall 11 in the first direction Y.

The coupling rod 2 includes two ends that are received in the receiving portions 14 of the two lateral walls 11, respectively. As such, the coupling rod 2 can be coupled with the mounting bracket 1. Since the receiving portion 14 is in the form of an opening in the embodiment, each end of the coupling rod 2 can extend into a respective receiving portion 14, increasing the contact areas between the coupling rod 2 and the lateral walls 11. The coupling rod 2 can rotate in the receiving portions 14 of the lateral walls 11. In other words, the coupling rod 2 can rotate about an axle parallel to the first direction Y.

The fan rod 3 includes a first end 31 and a second end 32. The first end 31 and the second end 32 are spaced from each other in the axial direction X. The first end 31 is coupled with the coupling rod 2, and the second end 32 is coupled with a stator 4 of a motor of the ceiling fan.

Figure 3:
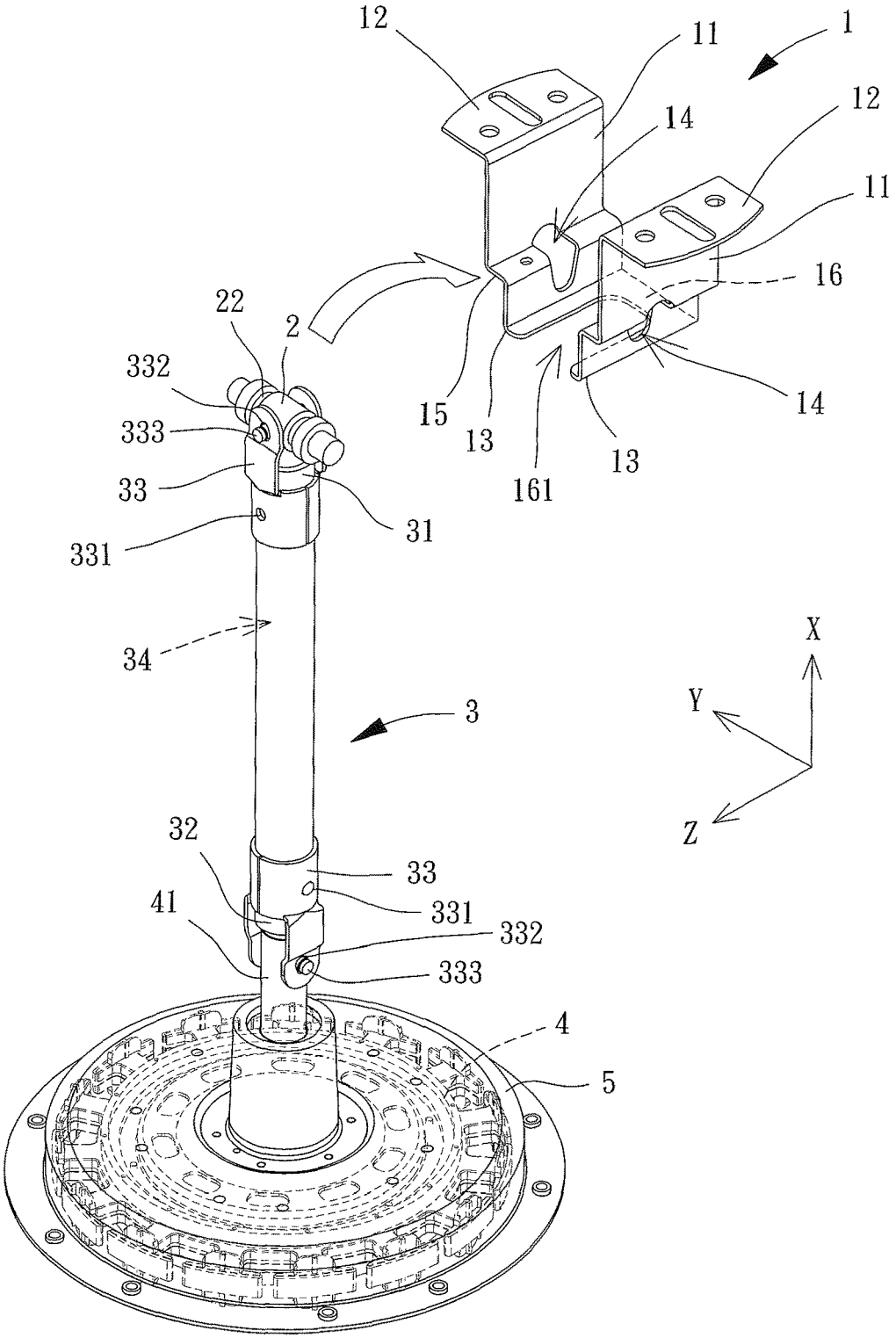
FIG. 3 shows a coupling process between a coupling rod and a mounting bracket of the ceiling fan according to the embodiment of the invention.

Based on the above structure, referring to FIG. 3, when the hanger assembly of the ceiling fan according to the embodiment of the invention is in use, the first end 31 of the fan rod 3 may be coupled with the coupling rod 2, and the second end 32 of the fan rod 3 can be coupled with the stator 4 of the motor of the ceiling fan. In such an arrangement, the coupling rod 2 can be coupled with the mounting bracket 1 by simply placing two ends of the coupling rod 2 respectively into the receiving portions 14 of the lateral walls 11, allowing the ceiling fan to be hung on the mounting bracket 1. Specifically, the motor of the ceiling fan may further include a rotor 5. The rotor 5 of the motor may be coupled with a plurality of blades, and is rotatably coupled with the stator 4 of the motor. As shown in FIG. 3, since the motor of the ceiling fan is usually of an outer-rotor type, the rotor 5 of the motor is rotatably coupled with an outer periphery of the stator 4 of the motor. The stator 4 of the motor includes a shaft tube 41 coupled with the second end 32 of the fan rod 3. As such, the stator 4 of the motor is able to drive the rotor 5 to rotate, such that the air current can be generated under the rotation of the blades.

Figure 4:
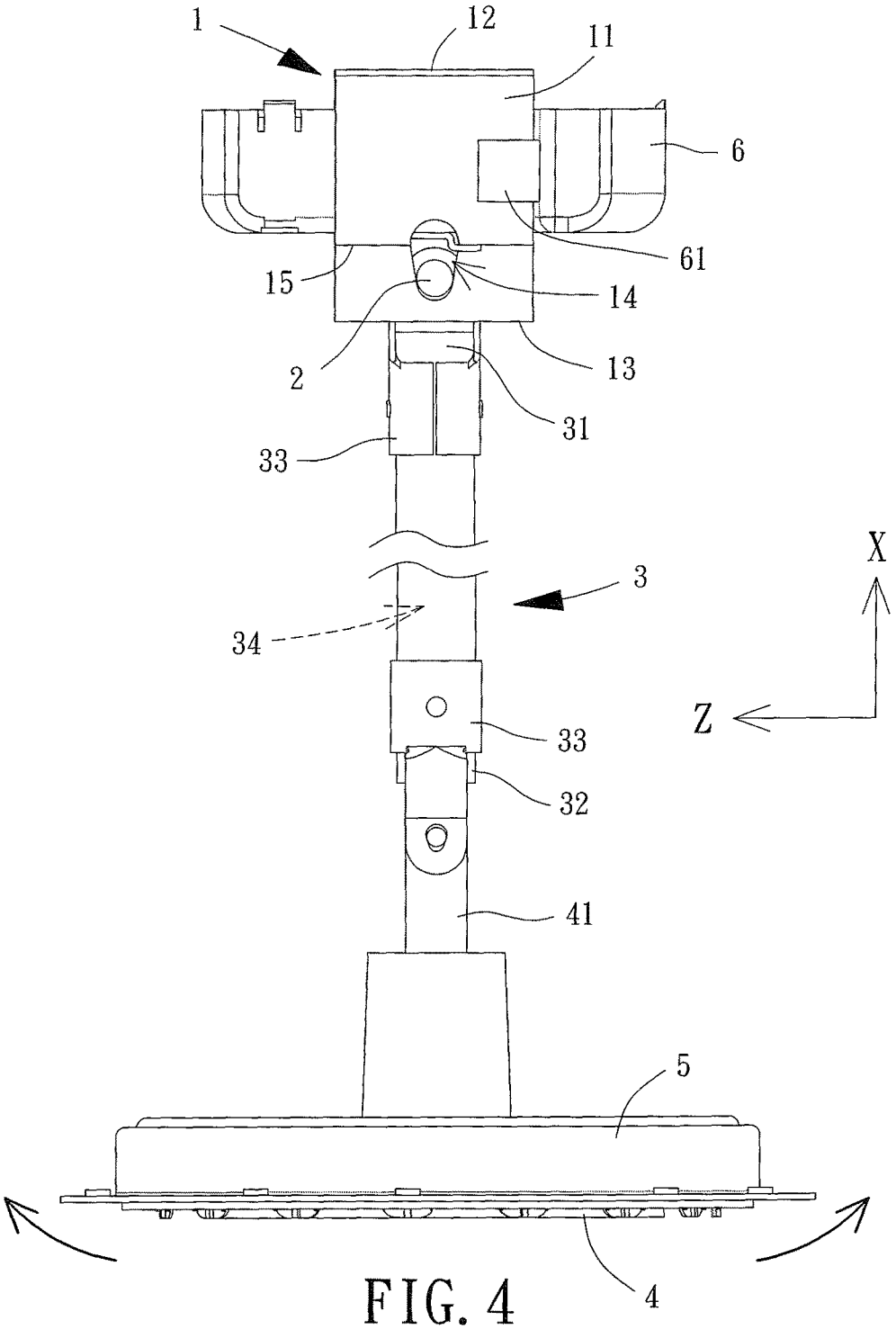
FIG. 4 is a side view of the ceiling fan taken along a first direction according to the embodiment of the invention.

Please also refer to FIG. 4, the coupling rod 2 is able to rotate in the receiving portions 14 of the two lateral walls 11. Therefore, the fan rod 3 and the stator 4 are able to swing relative to the mounting bracket 1 under the rotation of the coupling rod 2 when experiencing the external force. This prevents stress from concentrating on the interconnected part between the coupling rod 2 and the mounting bracket 1.

The first end 31 of the fan rod 3 is coupled with the coupling rod 2 via a connection member 33. The connection member 33 includes a retaining portion 331 and a coupling portion 332 located at two ends of the connection member 33, respectively. The retaining portion 331 may be fixed to the first end 31 of the fan rod 3, and the coupling portion 332 is pivotally coupled with the coupling rod 2. Alternatively, the retaining portion 331 may be fixed to the coupling rod 2, the coupling portion 332 is pivotally coupled with the first end 31 of the fan rod 3, and the coupling portion 332 is able to pivot about an axle parallel to a second direction Z. For example, in this embodiment, the retaining portion 331 is fixed to the first end 31 of the fan rod 3, and the coupling portion 332 is pivotally coupled with the coupling rod 2. However, the retaining portion 331 may also be fixed to the coupling rod 2, and the coupling portion 332 may also be pivotally coupled with the first end 31 of the fan rod 3. The invention is not limited to either implementation. In the embodiment, the coupling portion 332 may be in the form of a though-hole and may be coupled with a shaft 333. The coupling portion 332 is able to pivot about the shaft 333. The coupling rod 2 may include a hole 21 through which the shaft 333 can extend. As such, the coupling portion 332 can pivotally couple with the shaft 333. The shaft 333 is parallel to the second direction Z so that the coupling portion 332 can pivot about the axle parallel to the second direction Z.

Figure 5:
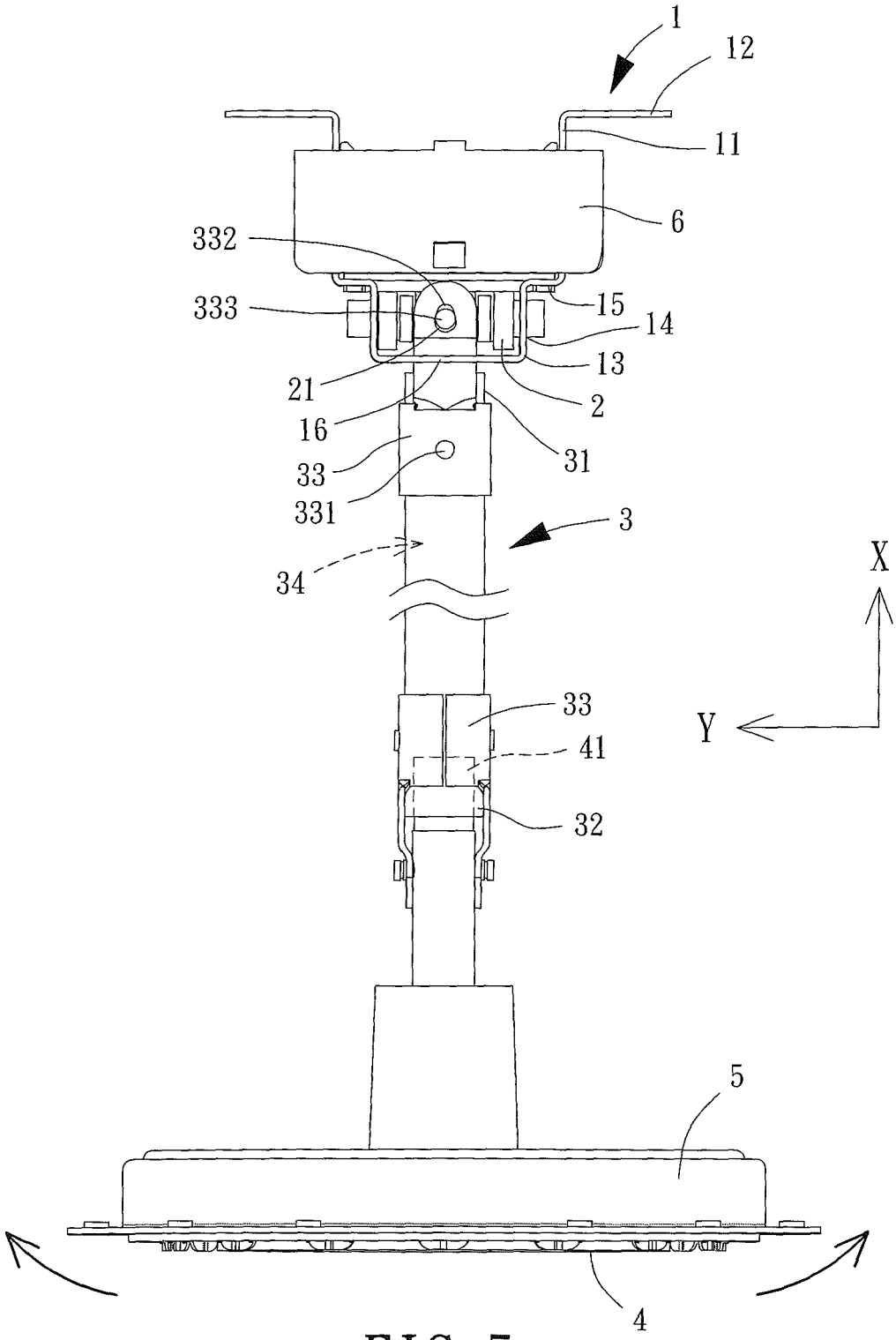
FIG. 5 is a side view of the ceiling fan taken along a second direction according to the embodiment of the invention.

Based on this, referring to FIG. 5, the coupling portion 332 of the connection member 33 can pivot about the shaft 333. As such, the stator 4 of the motor and the fan rod 3 are able to swing relative to the coupling rod 2 at the shaft 333 when experiencing the external force, preventing stress from concentrating on the interconnected part between the fan rod 3 and the coupling rod 2 (i.e. the connection member 33).

From the above, it can be known that the stator 4 of the motor and the fan rod 3 are able to swing relative to the mounting bracket 1 under the rotation of the coupling rod 2 when experiencing the external force, allowing the stator 4 of the motor and the fan rod 3 to swing in the first direction Y. Likewise, the stator 4 of the motor and the fan rod 3 are able to swing relative to the coupling rod 2 under the rotation of the shaft 333, allowing the stator 4 of the motor and the fan rod 3 to swing in the second direction Z. As such, the stator 4 of the motor and the fan rod 3 are able to swing in the first direction Y or the second direction Z when experiencing the external force acted in the axial direction X, thereby preventing stress from concentrating on the interconnected part between the coupling rod 2 and the mounting bracket 1 or between the fan rod 3 and the coupling rod 2. Advantageously, breaking of the coupling rod 2 or the fan rod 3 can be effectively prevented.

Figure 6:
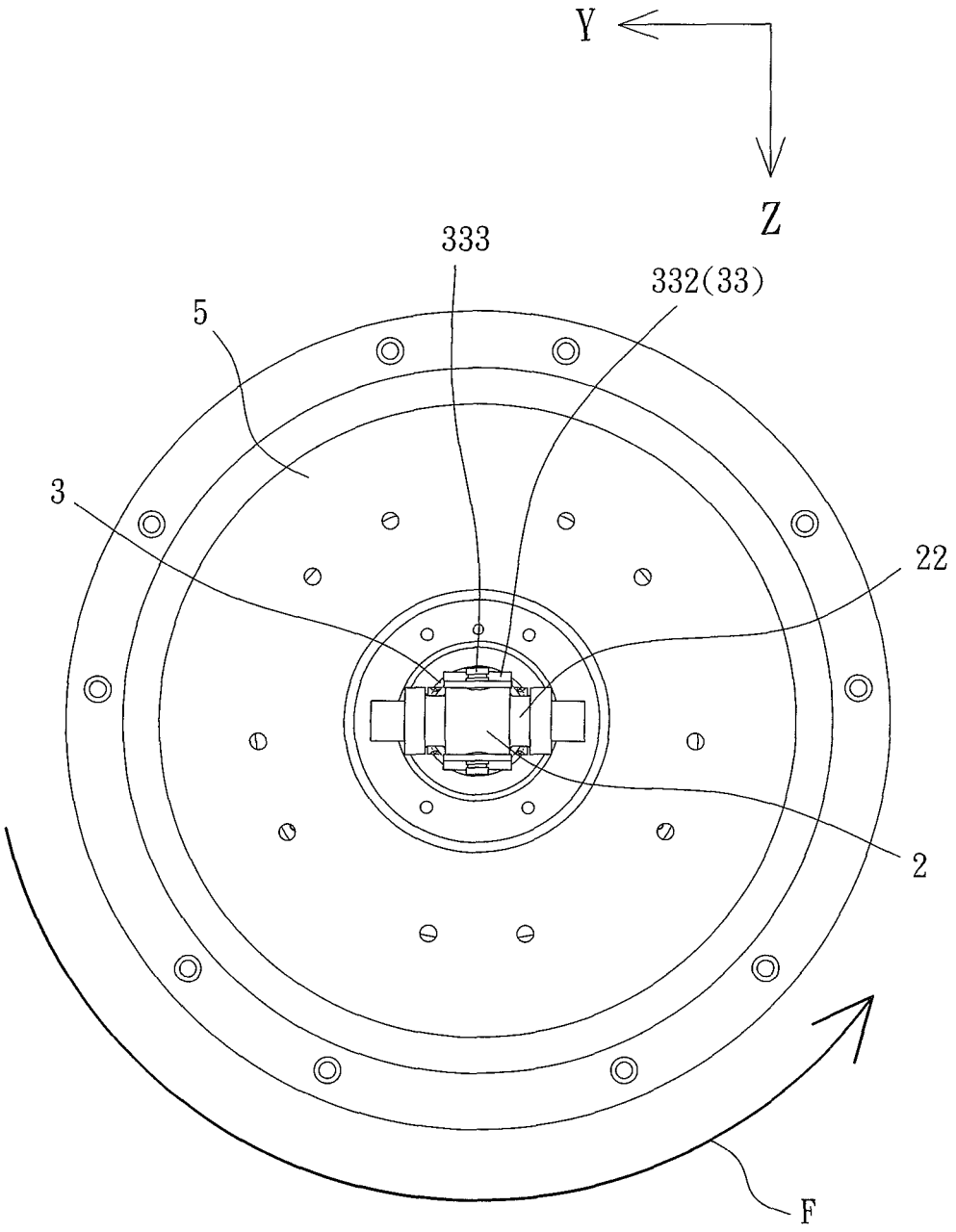
FIG. 6 is a top view of the ceiling fan taken along an axial direction according to the embodiment of the invention.

Referring to FIG. 6, during operation of the stator (not shown) of the motor, a rotor 5 of the motor must be driven to rotate. In this regard, the stator of the motor needs to bear a torque F acted in a circumferential direction. However, since the two ends of the coupling rod 2 are respectively received in the receiving portions 14 of the two lateral walls 11, the coupling rod 2 can only rotate about the axle parallel to the first direction Y. Similarly, in the embodiment, the coupling portion 332 is pivotally coupled with the coupling rod 2 via a shaft 333, and the shaft 333 extends through the hole 21 of the coupling rod 2 and is parallel to the second direction Z. Hence, the coupling portion 332 can only pivot about the axle parallel to the second direction Z. As such, the stator 4 of the motor and the fan rod 3 will not pivot about an axle parallel to the axial direction X when the stator 4 of the motor experiences the torque F, thus effectively preventing shaking of the stator 4 of the motor during the activation of the ceiling fan and prolonging the service life of the hanger assembly and the ceiling fan.

Based on the above structure, various features of the hanger assembly and the ceiling fan are elaborated below.

Figure 7:
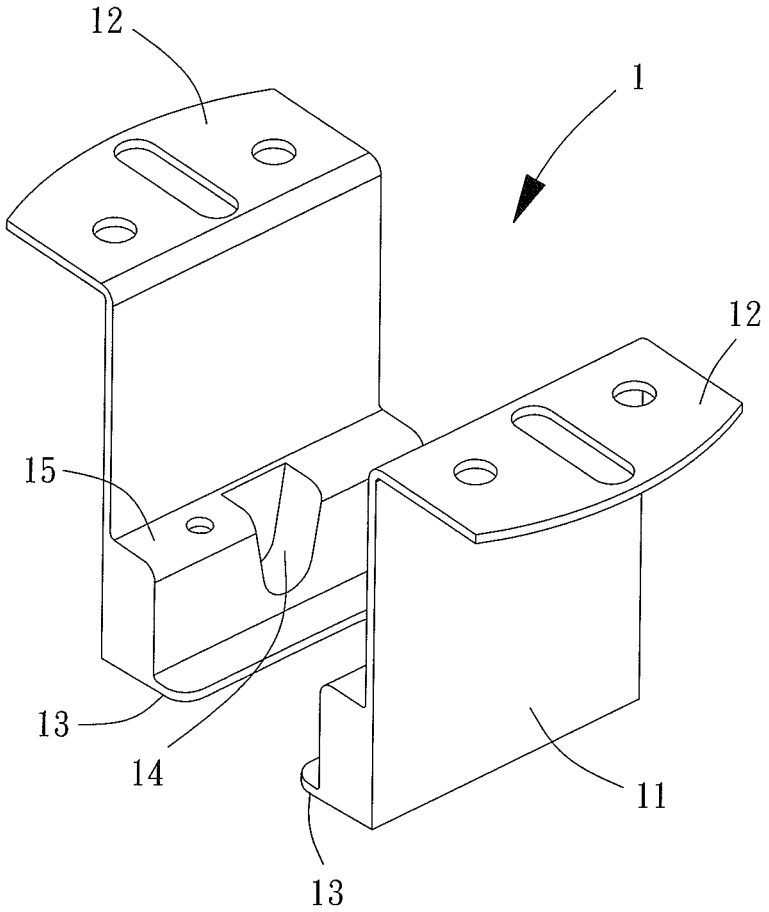
FIG. 7 shows the mounting bracket where a receiving portion thereof is in the form of a blind hole according to the embodiment of the invention.

In the above embodiment, although the receiving portion 14 of each lateral wall 11 is in the form of an opening extending through two surfaces of the lateral wall 11 in the first direction Y, the receiving portion 14 can also be in the form of a blind hole as shown in FIG. 7. In this regard, the two lateral walls 11 will include two blind holes respectively formed on the inner surfaces of the two lateral walls 11 and facing each other in the first direction Y. Since the receiving portions 14 of the two lateral walls 11 are aligned with each other in the first direction Y, the two ends of the coupling rod 2 can be received in the receiving portions 14, respectively. The blind holes can prevent the two ends of the coupling rod 2 from extending out of the two lateral walls 11, to prevent exposure of said ends of the coupling rod 2. As such, the two ends of the coupling rod 2 will not become rusty easily.

Figure 9:
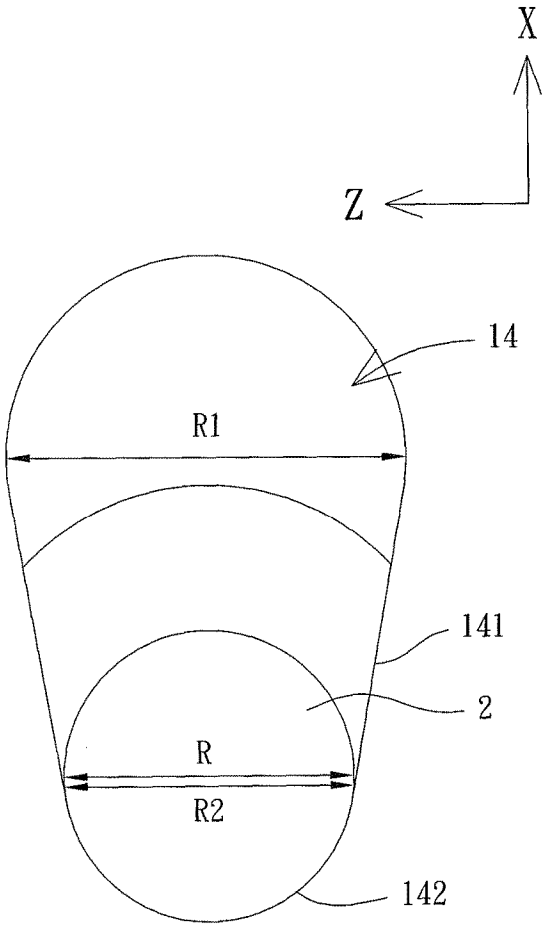
FIG. 9 shows the receiving portion of the lateral wall of the mounting bracket taken along the first direction, in which the coupling rod reaches a position of the receiving portion where the outer diameter of the end of the coupling rod is approximately the minimal diameter of the receiving portion, according to the embodiment of the invention.
Figure 8:
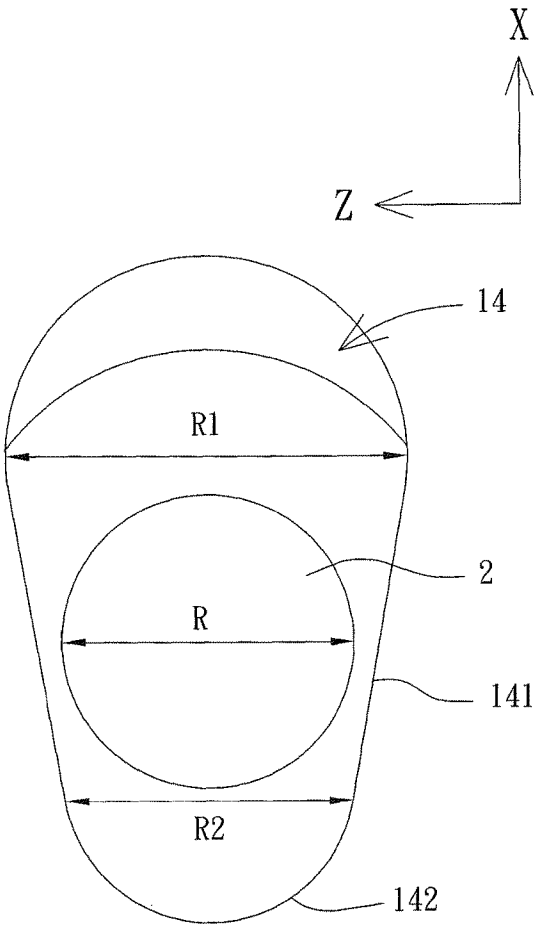
FIG. 8 shows the receiving portion of a lateral wall of the mounting bracket taken along the first direction according to the embodiment of the invention.

Reference to FIGS. 2, 4 and 8 is now made, in which FIG. 8 shows the receiving portion 14 of the lateral wall 11 viewed in the first direction Y. The receiving portion 14 includes a shrinking section 141 having two lateral edges spaced from each other in the second direction Z, and each of the two lateral edges of the shrinking section 141 may be in a linear form on a plane formed by the axial direction X and the second direction Z (perpendicular to the first direction Y). The diameter of the shrinking section 141 reduces from one end, which is relatively adjacent to the mounting end 12, to another end which is relatively adjacent to the hanger end 13. Specifically, the shrinking section 141 has a larger end relatively adjacent to the mounting end 12, as well as a smaller end relatively adjacent to the hanger end 13. The shrinking section 141 has a maximal diameter R1 in the second direction Z, as well as a minimal diameter R2 in the second direction Z. The maximal diameter R1 is located at the larger end, and the minimal diameter R2 is located at the smaller end. Each of the two ends of the coupling rod 2 has an outer diameter R. Based on this, the diameter of the shrinking section 141 (which is parallel to the second direction Z) gradually reduces from the position of the maximal diameter R1 to the position of the minimal diameter R2. The maximal diameter R1 is larger than the outer diameter R, and the minimal diameter R2 is smaller than or equal to the outer diameter R. The receiving portion 14 may further include a connection section 142 connected between the two lateral edges of the shrinking section 141 at the smaller end relatively adjacent to the hanger end 13. The connection section 142 may be in an arched form. Based on this, referring to FIG. 3 also, the two ends of the coupling rod 2 can be respectively placed into the receiving portions 14 of the two lateral walls 11 via the larger end of the shrinking section 141 relatively adjacent to the mounting end 12. Since the maximal diameter R1 is larger than the outer diameter R, the two ends of the coupling rod 2 can be easily placed into the receiving portions 14 of the two lateral walls 11, respectively. As such, the assembly of the coupling rod 2 and the mounting bracket 1 is convenient. Besides, referring to FIG. 9, each of the two ends of the coupling rod 2 may displace down the shrinking section 141 towards the hanger end 13 and become engaged with the receiving portion 14 when the coupling rod 2 reaches a position in the shrinking section 141 where the diameter of the shrinking section 141 is approximately the outer diameter R of the end of the coupling rod 2. As such, the two ends of the coupling rod 2 are fixed.

Figure 10:
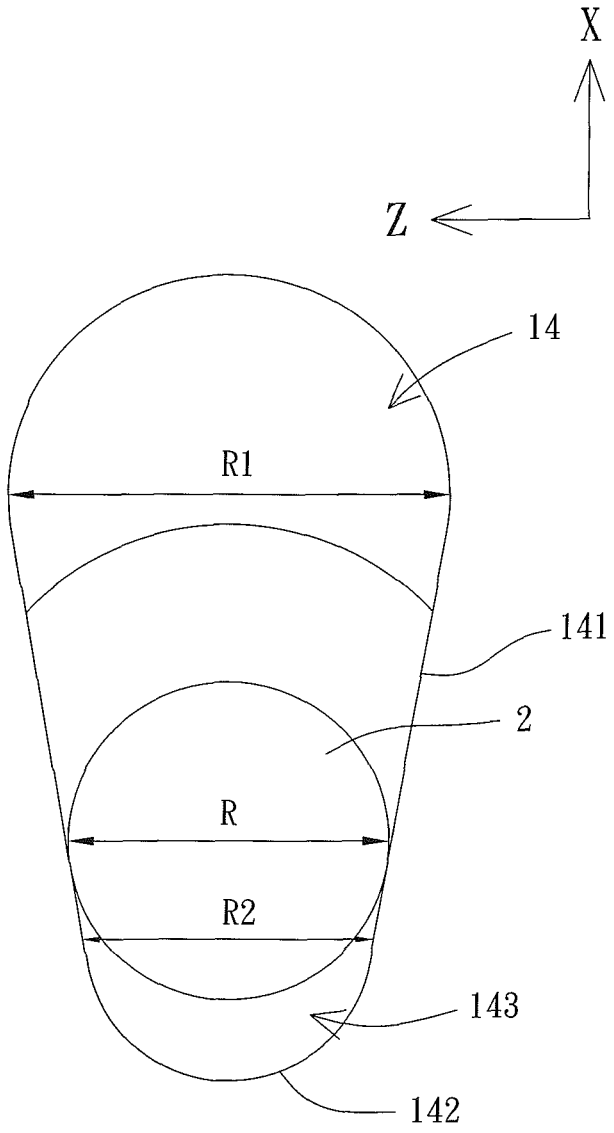
FIG. 10 shows the receiving portion of the lateral wall of the mounting bracket taken along the first direction, in which the minimal diameter of the receiving portion is smaller than the outer diameter of the end of the coupling rod, according to the embodiment of the invention.

In the embodiment, the minimal diameter R2 of the shrinking section 141 of the receiving portion 14 is equal to the outer diameter R of the end of the coupling rod 2. Therefore, the end of the coupling rod 2 can be engaged at the bottom side of the receiving portion 14 (i.e. the connection section 142), so that the two lateral walls 11 are able to provide a sufficient supporting force for the coupling rod 2. However, in another implementation shown in FIG. 10, the minimal diameter R2 of the shrinking section 141 of the receiving portion 14 can also be smaller than the outer diameter R of the end of the coupling rod 2. In this arrangement, the end of the coupling rod 2 will not be able to reach the bottom side of the receiving portion 14, forming a spacing 143 between the outer periphery of the end of the coupling rod 2 and the inner periphery of the connection section 142. Since the coupling rod 2 constantly rotates in the receiving portions 14 under the heavy weight of the fan rod 3 and the ceiling fan, friction between the coupling rod 2 and the two lateral walls 11 is caused such that the coupling rod 2 tends to wear down quickly at two ends thereof after a long term of use. Therefore, when the minimal diameter R2 of the shrinking section 141 of the receiving portion 14 is smaller than the outer diameter R of the end of the coupling rod 2, the end of the coupling rod 2 will displace further down the shrinking section 141 towards the hanger end 13 under gravity when the two ends of the coupling rod 2 have worn down. As a result, the end of the coupling rod 2 can remain engaged with the receiving portion 14, ensuring a stable coupling effect between the coupling rod 2 and the mounting bracket 1. Furthermore, since a spacing 143 will be formed between the outer periphery of the coupling rod 2 and the inner periphery of the receiving portion 14 at the connection section 142, the connection section 142 may be in the arched form, a linear form or other form without affecting the coupling effect between the coupling rod 2 and the mounting bracket 1.

Figure 11:
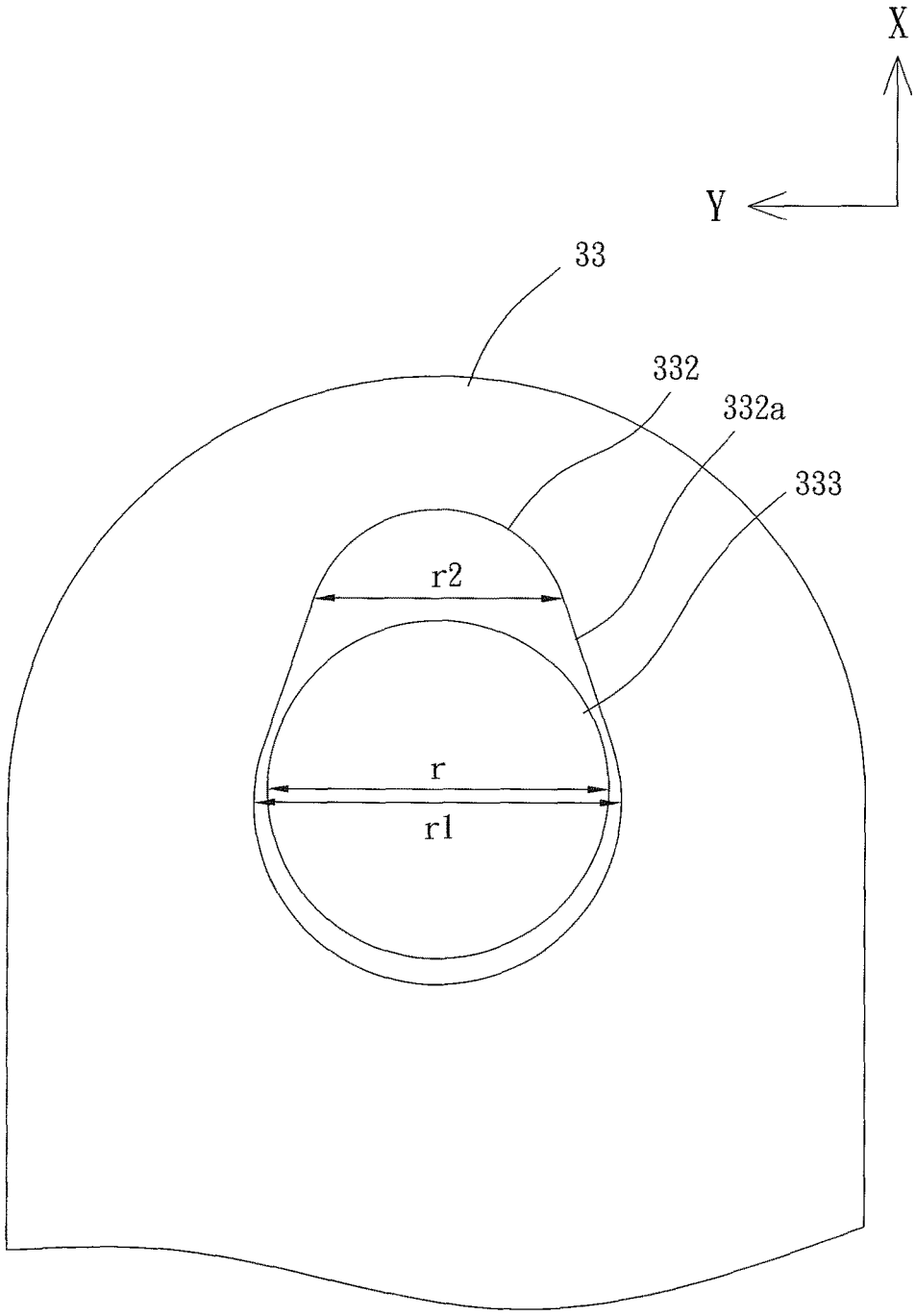
FIG. 11 shows a coupling portion of a connection member of a fan rod taken along the second direction according to the embodiment of the invention.
Figure 12:
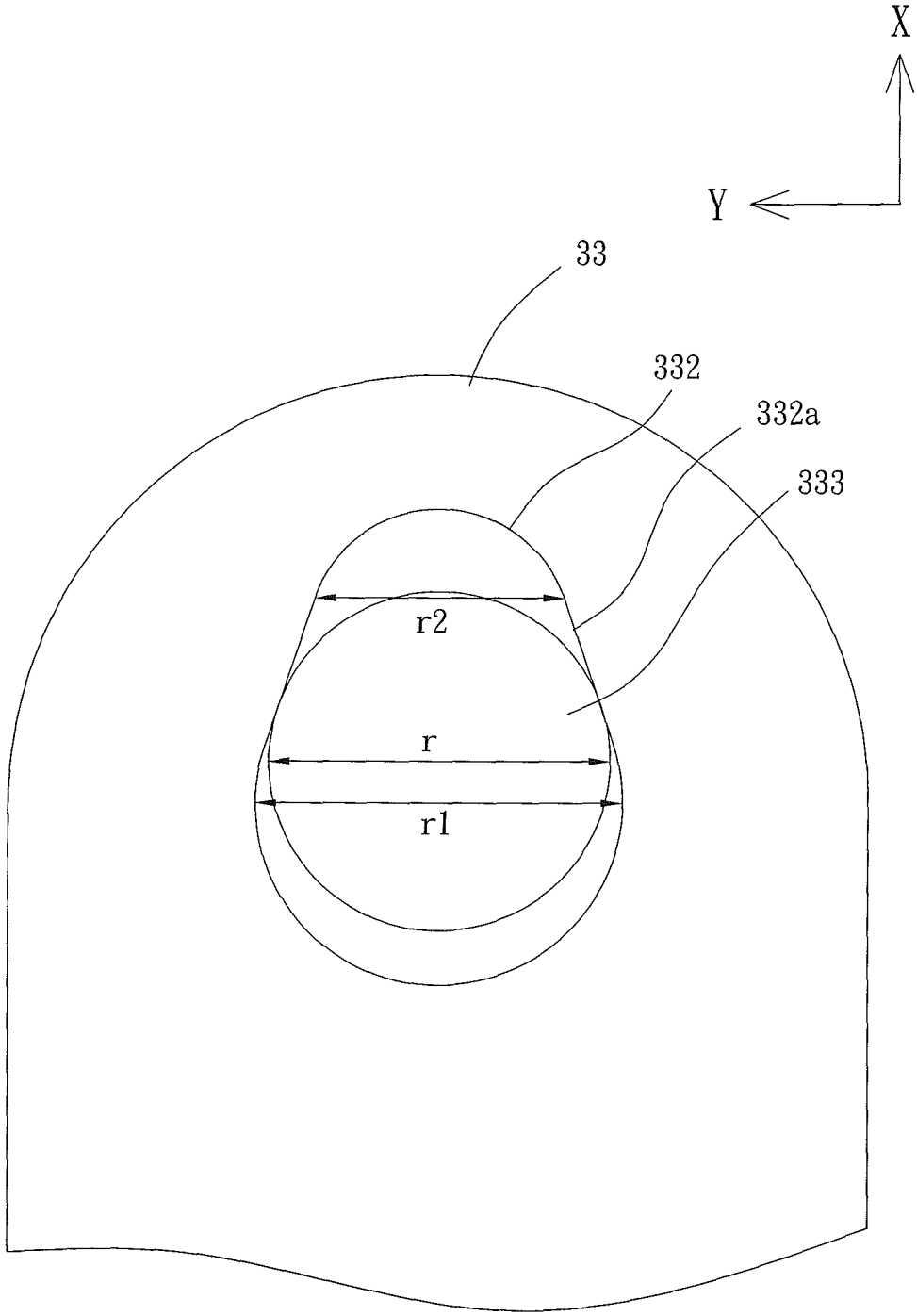
FIG. 12 shows the coupling portion of the connection member of the fan rod taken along the second direction, in which the minimal diameter of the coupling portion is smaller than an outer diameter of a shaft of the fan rod, according to the embodiment of the invention.

With reference made to FIGS. 2, 5 and 11, FIG. 11 shows the coupling portion 332 of the connection member 33 viewed in the second direction Z. The coupling portion 332 includes a reducing portion 332*a* having two sides spaced from each other in the first direction Y. Each of the two sides may be in a linear form on the plane perpendicular to the second direction Z. In addition, the reducing portion 332*a* includes a larger end relatively adjacent to the first end 31 of the fan rod 3, as well as a smaller end relatively distant to the first end 31 of the fan rod 3. Based on this, the inner diameter of the reducing portion 332*a* gradually reduces from the larger end to the smaller end. Specifically, the reducing portion 332*a* has a maximal inner diameter r1 in the first direction Y, as well as a minimal inner diameter r2 in the first direction Y. The maximal inner diameter r1 is located at the larger end, and the minimal inner diameter r2 is located at the smaller end. In addition, each end of the shaft 333 has an outer diameter r. The inner diameter of the reducing portion 332*a* gradually reduces from the position of the maximal inner diameter r1 to the position of the minimal inner diameter r2. The maximal inner diameter r1 is larger than the outer diameter r, and the minimal inner diameter r2 is smaller than or equal to the outer diameter r. In this arrangement, when it is desired to extend the shaft 333 through the coupling portion 332 in order to couple the shaft 333 with the coupling portion 332, the shaft 333 may extend through the reducing portion 332*a* via the larger end of the reducing portion 332*a* relatively adjacent to the first end 31 of the fan rod 3. In this regard, since the maximal inner diameter r1 is larger than the outer diameter r, the shaft 333 can easily extend through the coupling portion 332, providing a convenient engagement between the coupling portion 332 and the shaft 333. Besides, referring to FIGS. 3, 5 and 12, when the ceiling fan is hung on the mounting bracket 1, the coupling portion 332 can be pulled away from the mounting end 12 of the mounting bracket 1 by the fan rod 3. As such, the shaft 333 can displace in a direction away from the first end 31 along the reducing portion 332*a* until the shaft 333 reaches a position where the inner diameter of the reducing portion 332*a* is approximately the outer diameter r of the shaft 333. In this moment, the shaft 333 becomes engaged with the reducing portion 332*a* to fix the connection member 33 in place.

Referring to FIGS. 2-5, the second end 32 of the fan rod 3 can be connected to the stator 4 of the motor via another connection member 33. Specifically, the retaining portion 331 of the other connection member 33 can be fixed to the second end 32 of the fan rod 3. In this regard, the coupling portion 332 of the other connection member 33 is pivotally coupled with a shaft tube 41. Alternatively, the retaining portion 331 can be fixed to the shaft tube 41, and the coupling portion 332 is pivotally coupled with the second end 32 of the fan rod 3. In this arrangement, the two ends of the fan rod 3 can be respectively coupled with the stator 4 of the motor and the coupling rod 2 via the two connection members 33 that have the same structure. Thus, it is not necessary to prepare two different molds to manufacture two different connection members for connecting the fan rod 3 to the stator 4 of the motor and the coupling rod 2, thereby reducing the cost of the hanger assembly of the ceiling fan. Moreover, referring to FIG. 2, each of the two connection members 33 may further include two symmetric connection elements 33*a* in the embodiment. Since the symmetric connection elements 33*a* have a simpler structure, the production complexity of the connection members 33 can be reduced. On the other hand, as shown in FIG. 5, the fan rod 3 may include a channel 34 having two ends respectively in communication with the first end 31 and the second end 32 of the fan rod 3. Based on this, the shaft tube 41 of the stator 4 is extended into and fixed in the channel 34 of the fan rod 3 to prevent the stator 4 from pivoting relative to the fan rod 3. For example, in the embodiment, the shaft tube 41 may abut against an inner wall of the fan rod 3 forming the channel 34, to prevent the stator 4 of the motor from pivoting relative to the fan rod 3. As such, when the stator 4 of the motor and the fan rod 3 experience an external force, they will swing together in the first direction Y or the second direction Z. As a result, the stator 4 of the motor can be prevented from pivoting relative to the fan rod 3.

Besides, referring to FIGS. 2 and 3, the two ends of the fan rod 3 are respectively connected to the stator 4 of the motor and the coupling rod 2 via the two connection members 33 that have the same structure. In addition, the retaining portion 331 of the connection member 33 may be in the form of a screwing member (such as a screw or a pin). For the upper connection member 33 that is connected to the coupling rod 2, the retaining portion 331 of said connection member 33 may be arranged in a direction (the claimed first direction) non-parallel to the direction (the claimed second direction) of the retaining portion 331 of the lower connection member 33, that is connected to the stator 4 of the motor, on the plane perpendicular to the axial direction X. Preferably, the retaining portions 331 of the two connection members 33 are arranged perpendicular to each other to reinforce the coupling effect between the fan rod 3 and the stator 4 of the motor and the coupling rod 2.

Referring to FIGS. 2, 3 and 7, at least one of the two lateral walls 11 includes a step portion 15 arranged between the mounting end 12 and the hanger end 13, such that a spacing between the two mounting ends 12 of the lateral walls 11 is larger than a spacing between the two hanger ends 13 of the lateral walls 11. In this arrangement, the spacing between the two mounting ends 12 of the lateral walls 11 may be larger than the length of the coupling rod 2, the spacing between the two hanger ends 13 of the lateral walls 11 may be smaller than the length of the coupling rod 2, and the receiving portion 14 may extend through the step portion 15. When it is desired to hang the ceiling fan on the mounting bracket 1, the coupling rod 2 that is located right between the two mounting ends 12 may be placed further into the space between the two lateral walls 11, and then the coupling rod 2 is placed into the receiving portions 14 of the two lateral walls 11 along the axial direction X. Besides, the mounting bracket 1 may further include a bridge portion 16 connected between the hanger ends 13 of the two lateral walls 11 to reinforce the structural strength of the mounting bracket 1. Furthermore, a notch 161 may be formed between the hanger ends 13 of the two lateral walls 11 and the bridge portion 16. The fan rod 3 can extend through the notch 161. As such, when the coupling rod 2 that is located right between the two mounting ends 12 is placed further into the space between the two lateral walls 11, the fan rod 3 will not make contact with the mounting bracket 1.

Figure 13:
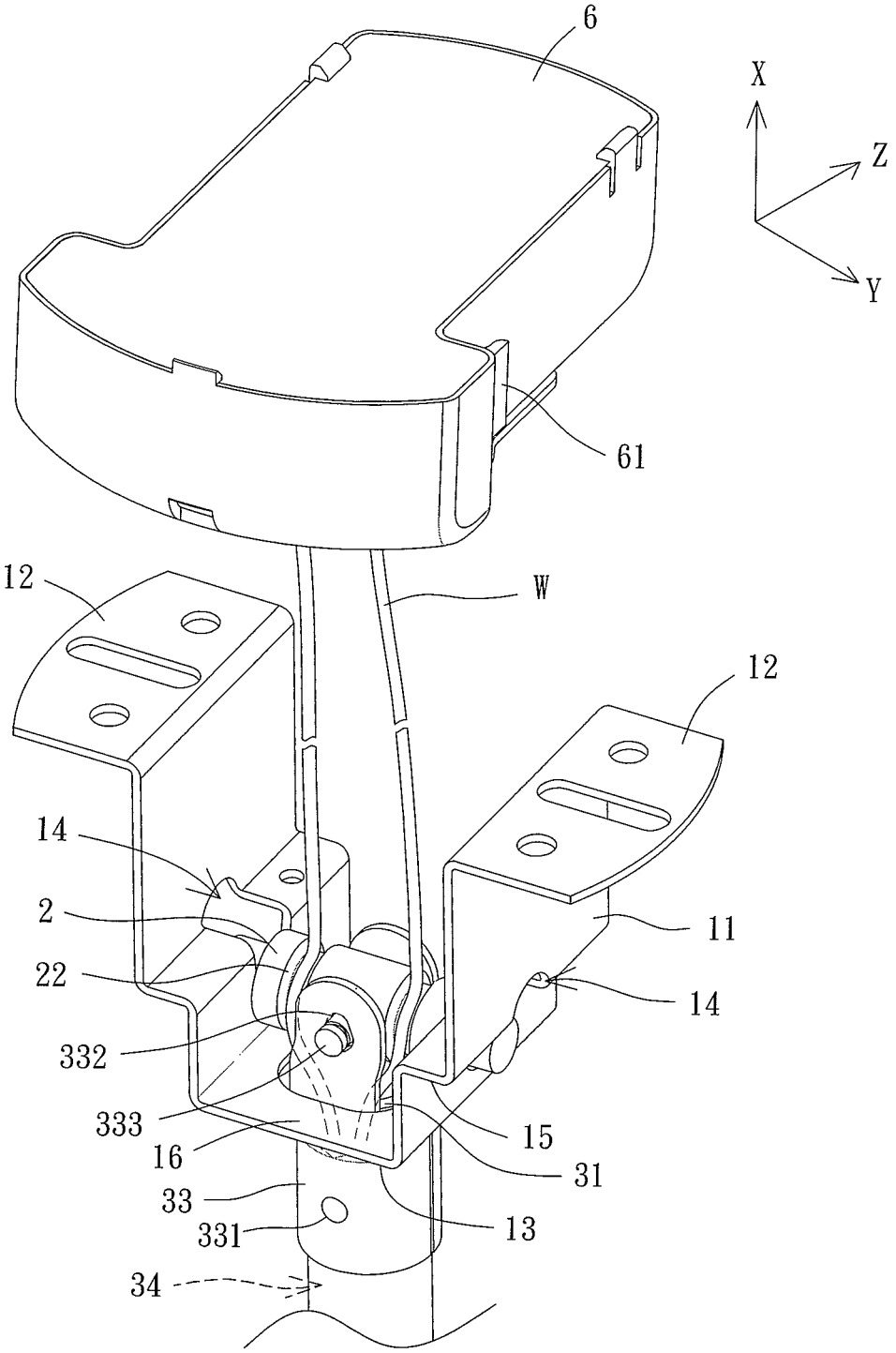
FIG. 13 shows the mounting bracket receiving a coupling rod that is provided with a wire groove according to the embodiment of the invention.

Referring to FIGS. 2, 3 and 13, a wire groove 22 may be arranged on an outer periphery of the coupling rod 2, so that a lead wire W can be arranged in the wire groove 22. Specifically, an electrical box 6 may be arranged between the mounting ends 12 of the two lateral walls 11 for receiving components such as a driving circuit board, a power converter or a controller. Based on this, the electrical box 6 may be provided with the lead wire W. Alternatively, when the mounting ends 12 of the two lateral walls 11 are mounted to a ceiling plate, a wire hole may be arranged on the ceiling plate for the lead wire W to extend therethrough. The wire groove 22 may be located between the mounting ends 12 of the two lateral walls 11 and is on the side of the fan rod 3 where the first end 31 is. In this arrangement, when the lead wire W passes through the space between the two mounting ends 12 and reaches the coupling rod 2, the lead wire W may extend along the wire groove 22. The wire groove 22 may be used as a wire path such that the lead wire W may extend to the first end 31 of the fan rod 3 through the path. Finally, the wire groove 22 extends into the channel 34 of the fan rod 3. As a result, the lead wire W may reach the second end 32 of the fan rod 3 or the shaft tube 41 of the stator 4 along the channel 34, to electrically connect to the internal components of the stator 4. Therefore, the electricity or control signal that is required for the operation of the stator 4 can be provided.

As stated above, when the stator 4 of the motor experiences the torque F, the stator 4 of the motor, the coupling rod 2 and the fan rod 3 will not pivot about the axle parallel to the axial direction X. Advantageously, the lead wire W in the wire groove 22, the channel 34 and the shaft tube 41 will not get twisted and become damaged. Therefore, the hanger assembly does effectively reduce the failure rate of the ceiling fan.

Figure 14:
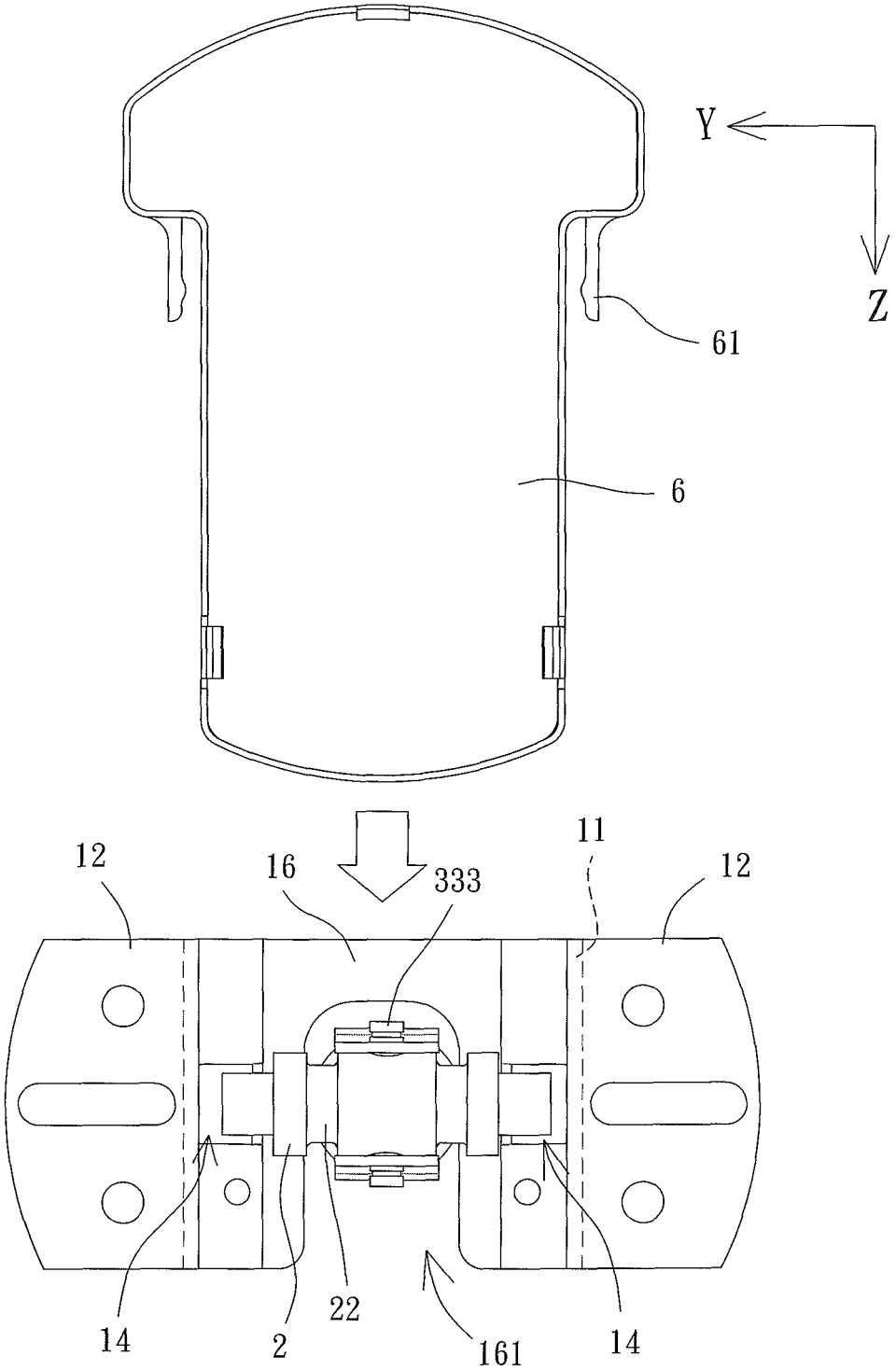
FIG. 14 is a top view of the mounting bracket in which an electrical box is to be inserted thereinto according to the embodiment of the invention.
Figure 15:
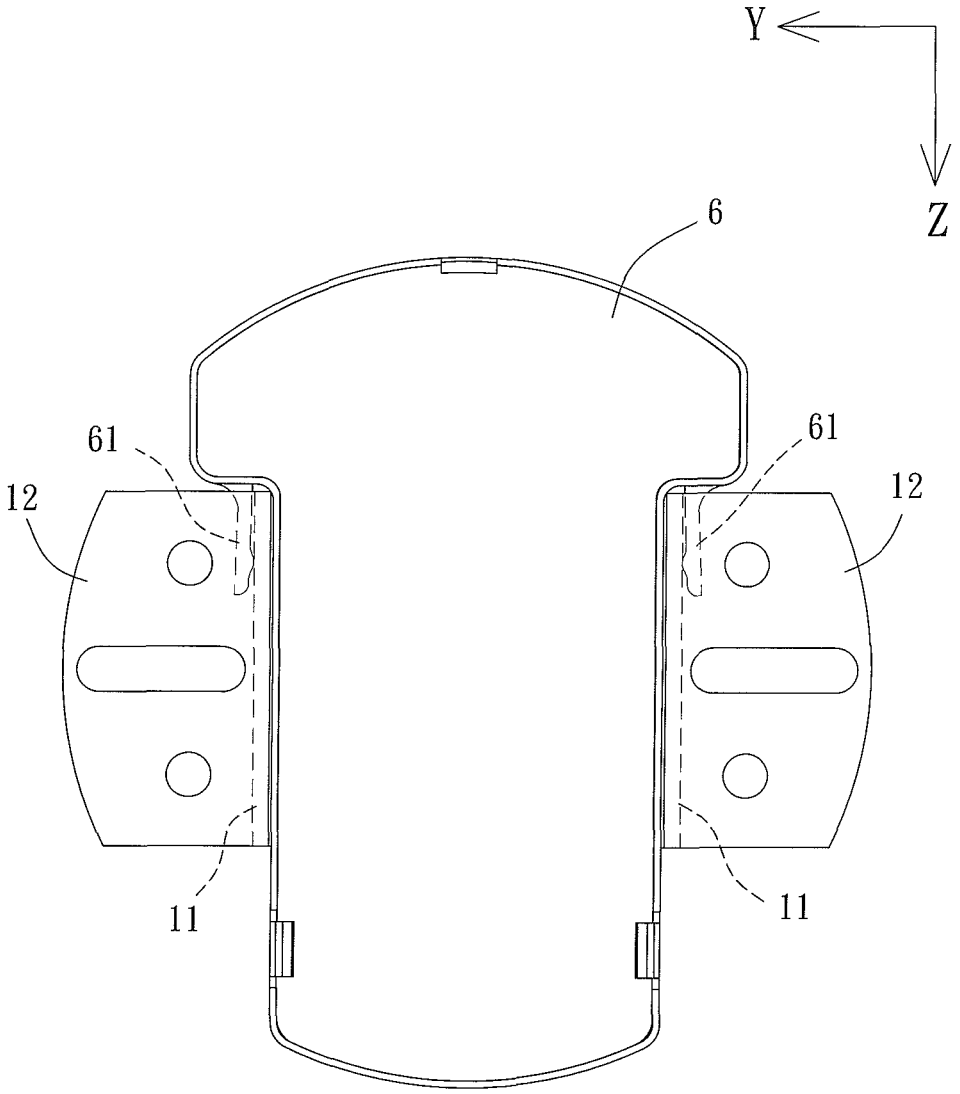
FIG. 15 is a top view of the mounting bracket in which the electrical box includes two engaging portions respectively engaged with the lateral walls of the mounting bracket.

Besides, an engaging portion 61 may be arranged on each of the two lateral surfaces of the electrical box 6 spaced from each other in the first direction Y. The engaging portion 61 may extend in the second direction Z and may be engaged with a respective lateral wall 11. Referring to FIGS. 14 and 15, in the embodiment, the electrical box 6 may be inserted into the mounting bracket 1 in the second direction Z, such that the electrical box 6 is located between the mounting ends 12 of the two lateral walls 11. In this regard, the two engaging portions 61 are respectively engaged with the two lateral walls 11 of the mounting bracket 1, thereby fixing the electrical box 6 to the mounting bracket 1. Since the two engaging portions 61 are able to provide a sufficient retaining effect for the electrical box 6, the electrical box 6 will not slide relative to the mounting bracket 1, thus preventing the lead wire W in the electrical box 6 from being pulled under such a sliding action. Thus, damage to the lead wire W is avoided, further reducing the failure rate of the ceiling fan.

In summary, through the arrangement of the receiving portions 14 on the two lateral walls 11 of the mounting bracket 1, the two ends of the coupling rod 2 are respectively received in the receiving portions 14. In this regard, the coupling rod 2 can only rotate in the receiving portions 14 without pivoting about the axle parallel to the axial direction X. Therefore, when the stator 4 of the motor experiences the torque F, the stator 4 of the motor and the fan rod 3 will not pivot about the axle parallel to the axial direction X. Advantageously, shaking of the stator 4 during the initialization process can be effectively prevented, prolonging the service life of the ceiling fan.

Moreover, since the receiving portions 14 of the two lateral walls 11 are spaced from each other in the first direction Y, the coupling rod 2 can rotate about the axle parallel to the first direction Y. In addition, the fan rod 3 may be connected to the coupling rod 2 via the connection member 33, and the connection member 33 includes the coupling portion 332 which can pivot about the axle parallel to the second direction Z. Thus, when the stator 4 of the motor and the fan rod 3 experience an external force applied in a direction perpendicular to the axial direction X, the stator 4 of the motor and the fan rod 3 will swing in the first direction Y or the second direction Z. Thus, stress will not concentrate on the interconnected part between the mounting bracket 1 and the coupling rod 2 or between the fan rod 3 and the coupling rod 2, effectively preventing breaking of the coupling rod 2 or the fan rod 3. Besides, since the coupling portion 332 cannot pivot about the axle parallel to the axial direction X, when the stator 4 of the motor experiences the torque F, the arrangement of the coupling portion 332 will not cause the stator 4 of the motor and the fan rod 3 to pivot about the axle parallel to the axial direction X.

Besides, since the stator 4 of the motor, the coupling rod 2 and the fan rod 3 cannot pivot about the axle parallel to the axial direction X, the lead wire W in the wire groove 22, the channel 34 and the shaft tube 41 will not get twisted and become damaged. As a result, the hanger assembly is able to effectively reduce the failure rate of the ceiling fan.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A hanger assembly of a ceiling fan, comprising:

a mounting bracket having two lateral walls opposite to each other in a first direction, wherein each of the two lateral walls comprises a mounting end, a hanger end and a receiving portion, wherein the mounting end and the hanger end are spaced from each other in an axial direction perpendicular to the first direction, wherein the receiving portion is spaced from the hanger end in the axial direction, wherein the receiving portions of the two lateral walls are aligned with each other in the first direction, and wherein the receiving portion is in a form of a blind holes;

a coupling rod having two ends respectively received in the receiving portions of the two lateral walls; and a fan rod having a first end coupled with the coupling rod, as well as a second end coupled with a stator of a motor of the ceiling fan.

2. The hanger assembly of the ceiling fan as claimed in claim 1, wherein the first and second ends of the fan rod are spaced from each other in the axial direction.

3. A ceiling fan comprising:

the hanger assembly as claimed in claim 1;

a stator of a motor; and a rotor of the motor coupled with a plurality of blades and rotatably coupled with the stator, wherein the stator is coupled with the second end of the fan rod and is configured to drive the rotor to rotate.

4. A hanger assembly of a ceiling fan, comprising:

a mounting bracket having two lateral walls opposite to each other in a first direction, wherein each of the two lateral walls comprises a mounting end, a hanger end and a receiving portion, wherein the mounting end and the hanger end are spaced from each other in an axial direction perpendicular to the first direction, wherein the receiving portion is spaced from the hanger end in the axial direction, wherein the receiving portions of the two lateral walls are aligned with each other in the first direction, wherein the receiving portion comprises a shrinking section having a larger end relatively adjacent to the mounting end, as well as a smaller end relatively adjacent to the hanger end, wherein the shrinking section has a maximal diameter in a second direction, as well as a minimal diameter in the second direction, wherein the maximal diameter is located at the larger end, wherein the minimal diameter is located at the smaller end, and wherein the shrinking section has a diameter that gradually reduces from the position of the maximal diameter to the position of the minimal diameter;

a coupling rod having two ends respectively received in the receiving portions of the two lateral walls, wherein the maximal diameter of the shrinking section is larger than an outer diameter of each of the two ends of the coupling rod, and wherein the minimal diameter of the shrinking section is smaller than or equal to the outer diameter of each of the two ends of the coupling rod; and a fan rod having a first end coupled with the coupling rod, as well as a second end coupled with a stator of a motor of the ceiling fan.

5. The hanger assembly of the ceiling fan as claimed in claim 4, wherein the receiving portion is in a form of an opening extending through the lateral wall in the first direction.

6. The hanger assembly of the ceiling fan as claimed in claim 4, wherein the shrinking section comprises two lateral edges spaced from each other in the second direction, and wherein each of the two lateral edges is in a linear form on a plane perpendicular to the first direction.

7. The hanger assembly of the ceiling fan as claimed in claim 4, wherein the minimal diameter of the shrinking section is equal to the outer diameter of each of the two ends of the coupling rod, wherein the shrinking section comprises two lateral edges spaced from each other in the second direction, wherein the receiving portion further comprises a connection section connected between the two lateral edges of the shrinking section at the smaller end of the shrinking section, and wherein the connection section is in an arched form.

8. The hanger assembly of the ceiling fan as claimed in claim 4, wherein the minimal diameter of the shrinking section is smaller than the outer diameter of each of the two ends of the coupling rod, wherein the shrinking section comprises two lateral edges spaced from each other in the second direction, wherein the receiving portion further comprises a connection section connected between the two lateral edges of the shrinking section at the smaller end of the shrinking section, and wherein a spacing is formed between an outer periphery of each of the two ends of the coupling rod and an inner periphery of the connection section of the receiving portion of a respective one of the two lateral walls.

9. A hanger assembly of a ceiling fan, comprising:

a mounting bracket having two lateral walls opposite to each other in a first direction, wherein each of the two lateral walls comprises a mounting end, a hanger end and a receiving portion, wherein the mounting end and the hanger end are spaced from each other in an axial direction perpendicular to the first direction, wherein the receiving portion is spaced from the hanger end in the axial direction, and wherein the receiving portions of the two lateral walls are aligned with each other in the first direction;

A coupling rod having two ends respectively received in the receiving portions of the two lateral walls; and a fan rod having a first end of coupled with the coupling rod via a connection member, as well as a second end coupled with a stator of a motor of the ceiling fan, wherein the connection member comprises a retaining portion and a coupling portion, wherein the retaining portion is fixed to the first end of the fan rod, wherein the coupling portion is pivotally coupled with the coupling rod, and wherein the coupling portion is capable of pivoting about an axle parallel to a second direction perpendicular to the axial direction and the first direction.

10. The hanger assembly of the ceiling fan as claimed in claim 9, wherein the coupling portion is in a form of a though-hole and coupled with a shaft, and wherein the shaft is parallel to the second direction.

11. The hanger assembly of the ceiling fan as claimed in claim 10, wherein the coupling rod comprises a hole through which the shaft extends.

12. The hanger assembly of the ceiling fan as claimed in claim 11, wherein the coupling portion comprises a reducing portion, wherein the reducing portion comprises a larger end relatively adjacent to the first end of the fan rod, as well as a smaller end relatively distant to the first end of the fan rod, wherein the reducing portion has an inner diameter that gradually reduces from the larger end to the smaller end, wherein the reducing portion has a maximal inner diameter in the first direction, as well as a minimal inner diameter in the first direction, wherein the maximal inner diameter is located at the larger end, wherein the minimal inner diameter is located at the smaller end, wherein the shaft has an outer diameter at each of two ends thereof, wherein the reducing portion has an inner diameter that gradually reduces from the position of the maximal inner diameter to the position of the minimal inner diameter, wherein the maximal inner diameter is larger than the outer diameter, and wherein the minimal inner diameter is smaller than or equal to the outer diameter.

13. The hanger assembly of the ceiling fan as claimed in claim 12, wherein the reducing portion has two sides spaced from each other in the first direction, and wherein each of the two sides of the reducing portion is in a linear form on a plane perpendicular to the second direction.

14. A ceiling fan comprising:

the hanger assembly as claimed in claim 9;

a stator of a motor; and a rotor of the motor coupled with a plurality of blades and rotatably coupled with the stator, wherein the stator is coupled with the second end of the fan rod and is configured to drive the rotor to rotate, and wherein the stator comprises a shaft tube;

wherein the second end of the fan rod is connected to the stator via another connection member, wherein the other connection member also comprises a retaining portion fixed to the second end of the fan rod, as well as a coupling portion pivotally coupled with the shaft tube.

15. The ceiling fan as claimed in claim 14, wherein the fan rod comprises a channel having two ends respectively in communication with the first and second ends of the fan rod, and wherein the shaft tube of the stator is extended into and fixed in the channel of the fan rod.

16. The ceiling fan as claimed in claim 14, wherein the retaining portions of the two connection members are perpendicular to each other.

17. A ceiling fan comprising:

the hanger assembly as claimed in claim 9;

a stator of a motor; and a rotor of the motor coupled with a plurality of blades and rotatably coupled with the stator, wherein the stator is coupled with the second end of the fan rod and is configured to drive the rotor to rotate, and wherein the stator comprises a shaft tube;

wherein the second end of the fan rod is connected to the stator via another connection member, wherein the other connection member also comprises a retaining portion fixed to the shaft tube, as well as a coupling portion pivotally coupled with the second end of the fan rod.

18. The ceiling fan as claimed in claim 17, wherein the fan rod comprises a channel having two ends respectively in communication with the first and second ends of the fan rod, and wherein the shaft tube of the stator is extended into and fixed in the channel of the fan rod.

19. The ceiling fan as claimed in claim 17, wherein the retaining portions of the two connection members are perpendicular to each other.

20. A hanger assembly of a ceiling fan, comprising:

a mounting bracket having two lateral walls opposite to each other in a first direction, wherein each of the two lateral walls comprises a mounting end, a hanger end and a receiving portion, wherein the mounting end and the hanger end are spaced from each other in an axial direction perpendicular to the first direction, wherein the receiving portion is spaced from the hanger end in the axial direction, and wherein the receiving portions of the two lateral walls are aligned with each other in the first direction;

a coupling rod having two ends respectively received in the receiving portions of the two lateral walls; and a fan rod having a first end coupled with the coupling rod via a connection member, as well as a second end coupled with a stator of a motor of the ceiling fan, wherein the connection member comprises a retaining portion and a coupling portion, wherein the retaining portion is fixed to the coupling rod, wherein the coupling portion is pivotally coupled with the first end of the fan rod, and wherein the coupling portion is capable of pivoting about an axle parallel to a second direction perpendicular to the axial direction and the first direction.

21. The hanger assembly of the ceiling fan as claimed in claim 20, wherein the coupling portion is in a form of a though-hole and coupled with a shaft, and wherein the shaft is parallel to the second direction.

22. A hanger assembly of a ceiling fan, comprising:

a mounting bracket having two lateral walls opposite to each other, wherein each of the two lateral walls comprises a mounting end, a hanger end and a receiving portion, wherein at least one of the two lateral walls comprises a step portion arranged between the mounting end and the hanger end, and wherein the receiving portion extends through the step portion;

a coupling rod having two ends respectively received in the receiving portions of the two lateral walls, wherein a spacing between the mounting ends of the two lateral walls is larger than a length of the coupling rod, and wherein a spacing between the hanger ends of the two lateral walls is smaller than the length of the coupling rod; and a fan rod having a first end coupled with the coupling rod, as well as a second end coupled with a stator of a motor of the ceiling fan.

23. A hanger assembly of a ceiling fan comprising:

a mounting bracket having two lateral walls opposite to each other, wherein each of the two lateral walls comprises a mounting end, a hanger end and a receiving portion, wherein the mounting bracket further comprises a bridge portion connected between the hanger ends of the two lateral walls;

a coupling rod having two ends respectively received in the receiving portions of the two lateral walls; and a fan rod having a first end coupled with the coupling rod, as well as a second end coupled with a stator of a motor of the ceiling fan.

24. The hanger assembly of the ceiling fan as claimed in claim 23, wherein the mounting end and the hanger end of the mounting bracket are spaced from each other in an axial direction, wherein the two lateral walls are opposite to each other in a first direction perpendicular to the axial direction, wherein the receiving portion is spaced from the hanger end in the axial direction, and wherein the receiving portions of the two lateral walls are aligned with each other in the first direction.

25. The hanger assembly of the ceiling fan as claimed in claim 23, wherein a notch is formed between the hanger ends of the two lateral walls and the bridge portion, and wherein the fan rod extends through the notch.

26. A hanger assembly of a ceiling fan, comprising:

a mounting bracket having two lateral walls opposite to each other, wherein each of the two lateral walls comprises a mounting end, a hanger end and a receiving portion;

a coupling rod having two ends respectively received in the receiving portions of the two lateral walls; and a fan rod having a first end coupled with the coupling rod, as well as a second end coupled with a stator of a motor of the ceiling fan, wherein a wire groove is arranged on an outer periphery of the coupling rod, and wherein the wire groove is located between the mounting ends of the two lateral walls and is on the side of the fan rod where the first end is.

27. The hanger assembly of the ceiling fan as claimed in claim 26, wherein an electrical box is arranged between the mounting ends of the two lateral walls, wherein the electrical box is provided with a lead wire, and wherein the lead wire passes through a space between the mounting ends of the two lateral walls, reaches the coupling rod, and extends to the first end of the fan rod through the wire groove.

28. The hanger assembly of the ceiling fan as claimed in claim 27, wherein the electrical box comprises an engaging portion engaged with one of the two lateral walls.

29. The hanger assembly of the ceiling fan as claimed in claim 26, wherein the mounting end and the hanger end of the mounting bracket are spaced from each other in an axial direction, wherein the two lateral walls are opposite to each other in a first direction perpendicular to the axial direction, wherein the receiving portion is spaced from the hanger end in the axial direction, and wherein the receiving portions of the two lateral walls are aligned with each other in the first direction.

30. A mounting bracket of a hanger assembly of a ceiling fan, comprising two lateral walls opposite to each other in a first direction, wherein each of the two lateral walls comprises a mounting end and a hanger end that are spaced from each other in an axial direction perpendicular to the first direction, wherein each of the two lateral walls further comprises a receiving portion, and wherein the receiving portions of the two lateral walls are adapted to receive a coupling rod.

31. The mounting bracket of the hanger assembly of the ceiling fan as claimed in claim 30, wherein the receiving portion is spaced from the hanger end in the axial direction.

32. The mounting bracket of the hanger assembly of the ceiling fan as claimed in claim 30, wherein the receiving portion is in a form of an opening extending through the lateral wall in the first direction.

33. The mounting bracket of the hanger assembly of the ceiling fan as claimed in claim 30, wherein the receiving portion is in a form of a blind hole.

34. The mounting bracket of the hanger assembly of the ceiling fan as claimed in claim 30, wherein the receiving portion comprises a shrinking section having a larger end relatively adjacent to the mounting end, as well as a smaller end relatively adjacent to the hanger end, wherein the shrinking section has a maximal diameter in a second direction, as well as a minimal diameter in the second direction, wherein the maximal diameter is located at the larger end, wherein the minimal diameter is located at the smaller end, wherein the coupling rod has two ends, wherein the shrinking section has a diameter that gradually reduces from the position of the maximal diameter to the position of the minimal diameter, wherein the maximal diameter of the shrinking section is larger than an outer diameter of each of the two ends of the coupling rod, and wherein the minimal diameter of the shrinking section is smaller than or equal to the outer diameter of each of the two ends of the coupling rod.

35. The mounting bracket of the hanger assembly of the ceiling fan as claimed in claim 34, wherein the shrinking section comprises two lateral edges spaced from each other in the second direction, and wherein each of the two lateral edges is in a linear form on a plane perpendicular to the first direction.

36. The mounting bracket of the hanger assembly of the ceiling fan as claimed in claim 34, wherein the minimal diameter of the shrinking section is equal to the outer diameter of each of the two ends of the coupling rod, wherein the shrinking section comprises two lateral edges spaced from each other in the second direction, wherein the receiving portion further comprises a connection section connected between the two lateral edges of the shrinking section at the smaller end of the shrinking section, and wherein the connection section is in an arched form.

37. The mounting bracket of the hanger assembly of the ceiling fan as claimed in claim 34, wherein the minimal diameter of the shrinking section is smaller than the outer diameter of each of the two ends of the coupling rod, wherein the shrinking section comprises two lateral edges spaced from each other in the second direction, wherein the receiving portion further comprises a connection section connected between the two lateral edges of the shrinking section at the smaller end of the shrinking section, and wherein a spacing is formed between an outer periphery of each of the two ends of the coupling rod and an inner periphery of the connection section of the receiving portion of a respective one of the two lateral walls.

38. The mounting bracket of the hanger assembly of the ceiling fan as claimed in claim 30, wherein at least one of the two lateral walls comprises a step portion arranged between the mounting end and the hanger end, wherein the receiving portion extends through the step portion, wherein a spacing between the mounting ends of the two lateral walls is larger than a length of the coupling rod, and wherein a spacing between the hanger ends of the two lateral walls is smaller than the length of the coupling rod.

39. The mounting bracket of the hanger assembly of the ceiling fan as claimed in claim 30, wherein the mounting bracket further comprises a bridge portion connected between the hanger ends of the two lateral walls.

40. The mounting bracket of the hanger assembly of the ceiling fan as claimed in claim 39, wherein a notch is formed between the hanger ends of the two lateral walls and the bridge portion.

41. The mounting bracket of the hanger assembly of the ceiling fan as claimed in claim 30, wherein an electrical box is arranged between the mounting ends of the two lateral walls, wherein the electrical box is provided with a lead wire, and wherein the lead wire passes through a space between the mounting ends of the two lateral walls and reaches the coupling rod.

42. The mounting bracket of the hanger assembly of the ceiling fan as claimed in claim 41, wherein the electrical box comprises an engaging portion engaged with one of the two lateral walls.

* * * * *